US010037554B2

(12) United States Patent
Prokopenko et al.

(10) Patent No.: US 10,037,554 B2
(45) Date of Patent: Jul. 31, 2018

(54) AGGREGATED BILLING FOR APPLICATION-BASED NETWORK ACCESS AND CONTENT CONSUMPTION

(71) Applicant: Rawllin International Inc., Tortola (VG)

(72) Inventors: Anton Prokopenko, Saint-Petersburg (RU); Konstantin Malets, Saint-Petersburg (RU); Denis Kulikov, Saint-Petersburg (RU)

(73) Assignee: VIGO SOFTWARE LTD, Nicosia (CY)

( * ) Notice: Subject to any disclaimer, the term of this patent is extended or adjusted under 35 U.S.C. 154(b) by 648 days.

(21) Appl. No.: 14/067,458

(22) Filed: Oct. 30, 2013

(65) Prior Publication Data

US 2015/0120520 A1 Apr. 30, 2015

(51) Int. Cl.
*G06Q 30/04* (2012.01)

(52) U.S. Cl.
CPC ..... *G06Q 30/04* (2013.01)

(58) Field of Classification Search
None
See application file for complete search history.

(56) References Cited

U.S. PATENT DOCUMENTS 6,425,010 B1 7/2002 Alles et al.
6,449,739 B1 9/2002 Landan
6,914,883 B2 7/2005 Dharanikota
7,236,950 B2 * 6/2007 Savage ..... G06Q 20/02 705/31
7,353,267 B1 4/2008 Cunningham et al.
7,536,561 B2 5/2009 Warnock et al.
7,602,723 B2 10/2009 Mandato et al.
7,647,259 B2 1/2010 de Fabrega
7,848,312 B2 12/2010 Zhang et al.
7,895,297 B2 2/2011 Gorodyansky
(Continued)

FOREIGN PATENT DOCUMENTS

WO 01/89190 A2 11/2001

OTHER PUBLICATIONS ("iOS 7 How-to: Monitor & track your cellular data usage", Sep. 2013, available at https://9to5mac.com/2013/09/25/ios-7-how-to-monitor-track-your-cellular-data-usage/.*
(Continued)

*Primary Examiner* — Allen C Chein
(74) *Attorney, Agent, or Firm* — Amin, Turocy & Watson, LLP

(57) ABSTRACT

Providing for aggregate billing related to provisioning network access and network content to an application or device is described herein. By way of example, the application or device (e.g., a client, . . . ) can be provided network access at a discounted rate to access content of content provider. The network access can be general access, or can be limited access to one or more web-pages, domains, hosts, etc. in various embodiments. Charges for content consumed by the client can be an aggregated charge that includes charges for the content and charges for the network access. In various embodiments, network access can facilitate a relatively persistent connection to a network, with network access charges aggregated into charges for consumption of online content or utilization of online services, or vice versa.

18 Claims, 11 Drawing Sheets

(56) References Cited

U.S. PATENT DOCUMENTS

| | | | | |
|---|---|---|---|---|
| 7,917,749 | B2 | 3/2011 | Ginter et al. | |
| 8,085,713 | B2 | 12/2011 | Kang | |
| 8,111,618 | B2 | 2/2012 | Li et al. | |
| 8,131,262 | B2 * | 3/2012 | Trioano | G06Q 30/02 455/432.2 |
| 8,145,263 | B2 | 3/2012 | van Rooyen | |
| 8,191,117 | B2 | 5/2012 | Lapidous | |
| 8,296,192 | B2 | 10/2012 | Bullock | |
| 8,543,842 | B2 | 9/2013 | Ginter et al. | |
| 8,635,128 | B2 * | 1/2014 | Fan | G06Q 30/04 370/252 |
| 8,776,175 | B1 | 7/2014 | Hermes | |
| 8,793,305 | B2 * | 7/2014 | Fiatal | G06Q 30/04 705/44 |
| 9,412,122 | B2 | 8/2016 | Trauberg | |
| 2001/0039497 | A1 | 11/2001 | Hubbard | |
| 2002/0194251 | A1 | 12/2002 | Richter et al. | |
| 2003/0229588 | A1 * | 12/2003 | Falk | G06Q 30/04 705/40 |
| 2005/0022001 | A1 | 1/2005 | Bahl et al. | |
| 2006/0085478 | A1 | 4/2006 | Landau et al. | |
| 2006/0195856 | A1 * | 8/2006 | Solomon | G06Q 30/00 725/5 |
| 2006/0259359 | A1 | 11/2006 | Gogel | |
| 2008/0004978 | A1 | 1/2008 | Rothschild | |
| 2008/0016533 | A1 | 1/2008 | Rothschild | |
| 2009/0287764 | A1 | 11/2009 | Pazhyannur et al. | |
| 2010/0107225 | A1 | 4/2010 | Spencer et al. | |
| 2010/0332615 | A1 | 12/2010 | Short et al. | |
| 2011/0145115 | A1 * | 6/2011 | Kim | G06Q 30/04 705/34 |
| 2011/0166918 | A1 | 7/2011 | Allaire et al. | |
| 2011/0302017 | A1 * | 12/2011 | Marti | G06Q 30/0225 705/14.26 |
| 2013/0080895 | A1 | 3/2013 | Rossman et al. | |
| 2013/0254082 | A1 * | 9/2013 | Zuber | G06Q 30/04 705/34 |

OTHER PUBLICATIONS

Office Action dated Jul. 20, 2015 for U.S. Appl. No. 13/917,232, 45 Pages.
Office Action dated Apr. 8, 2015 for U.S. Appl. No. 13/784,228, 41 Pages.
Office Action dated Nov. 16, 2015 for U.S. Appl. No. 13/917,232, 19 pages.
Office Action dated Dec. 23, 2015 for U.S. Appl. No. 13/784,228, 30 pages.
Patentability Search Report; "A network service management system that provides fee-based network services, billing on a per-use basis for consumed network content"; Dec. 12, 2012; 10 pages.
Office Action dated Mar. 18, 2016 for U.S. Appl. No. 13/917,232, 35 pages.
Notice of Allowance dated Dec. 1, 2016 for U.S. Appl. No. 13,784,228, 30 pages.
Notice of Allowance dated Sep. 19, 2016 for U.S. Appl. No. 13/917,232, 18 pages.
Altmann, "A Reference Model of Internet Service Provider Businesses", Accessed Nov. 13, 2013, 8 pages.
Turbo Internet Accelerator Features (New Version 2.1), published online, Accessed Nov. 13, 2013, 2 pages.
Wikipedia. "Freernium", published online at [http://en.wikipedia.org/wiki/Freemium], Accessed Nov. 13, 2013, 5 pages.
Wikipedia. "Free-to-play", published online at [http://en.wikipedia.org/wiki/Free-to-play], Accessed Nov. 13, 2013, 7 pages.
Wikipedia. "Spotify", published online, Accessed Nov. 13, 2013, 27 pages.
Weinberg, "Speed's Other Needs" published online at [http://techcrunch.com/2012/09/23/speeds-other-needs/], on Sep. 23, 2012, 3 pages.
Patentability Search Report; Data Acquisition Pertaining to Connectivity of Client Devices of Provider Network, and corresponding Availability/Utilization of Provider Network; Sep. 1, 2012, 11 pages.
Patentability Search Report; "A network service management system that provides fee-basednetwork services, billing on a per-use basis for consumed network content"; Dec. 12, 2012; 10 pages.

* cited by examiner 400 cont.

AGGREGATED BILLING FOR APPLICATION-BASED NETWORK ACCESS AND CONTENT CONSUMPTION

TECHNICAL FIELD

The subject disclosure relates generally to provision of media content over a network, e.g., facilitating free or discounted network access and content consumption services and aggregated billing therefor.

BACKGROUND

Advancements in high-speed last mile access to wide area networks, such as the Internet, have enabled consumers to greatly expand the scope and diversity of content they can receive through electronic communications. Likewise, advancements in network storage space, such as cloud storage in one example, and multiple access server technology has enabled multimedia service providers to store and distribute larger and more diverse content. Such content can include media, multimedia, text, graphics, and so on. Network-stored media in particular is becoming very popular, ranging from relatively small audio content like songs and ringtones, to larger podcasts, full length movies, and even much larger audio-video content. It is not hyperbole to say, therefore, that fixed electronic communication systems have become a backbone of industrial, commercial and personal communications worldwide. Likewise, mobile communication networks have provided voice and data communication functionality that have become near-ubiquitous for both business and personal communications throughout much of the world. Content-related communication, for audio/video entertainment, single player and multiplayer online games, and the like, has also become popular, utilizing the fundamental architecture of the Internet and associated webs or networks as the underlying data/content communication platform.

Two examples of network service providers include network access providers and network content providers (referred to herein collectively as content providers). Network access providers apply network access resources to facilitate communication between a network (e.g., the Internet, an intranet, a peer-to-peer network, etc.) and a subscriber's computer. Content providers transmit or facilitate access to online services, online media content, and so forth, to computers connected to the network. In this way, the subscriber can access the network as well as consume content and services offered via the network.

A popular interface between the service provider and the consumer is a subscriber account. A consumer provides identification information and establishes login credentials for purposes of identifying themselves and restricting access to the subscriber account. Upon authorizing access to a subscriber account, selected content or services requested via a client device logged in to the subscriber account can be delivered over a network for consumption. This framework enables content providers to track the usage of a particular subscriber, to facilitate billing the account for content and services consumed via the account.

In addition, the subscriber account can store information or choices about content services, content delivery services or the content itself, client device information, and so on, via the subscriber account. Thus, different levels of service can be established for different subscribers, and different billing rates established for different levels of service, all stored at the subscriber account. This enables network content providers to provide a range of billing rates and therefore accommodate a range of costs for a population of consumers. It also enables content providers to distribute specialized services or features for a subset of consumers who are interested in those services or features. Thus, the subscriber account facilitates a great deal of diversity in online content services.

Because network multimedia content is managed via client-server communications over a network, client authorization and user verification procedures are employed to control client access to content. A server might, for instance, be provisioned to check that a client device is associated with a subscription account offered by a particular content provider. This allows a service provider to limit content delivery to those users who have an agreement with the service provider, as well as protect intellectual property rights of content owners. As technology associated with consumer playback devices and network access infrastructure changes, providers typically adapt their services to achieve new possibilities made available by these technological changes. This evolution in technology is ongoing, and generates seemingly perpetual demand to expand upon or improve existing content or services to match these changes, and is one of many current challenges related to online multimedia content delivery.

SUMMARY

The following description and the annexed drawings set forth in detail certain illustrative aspects of the disclosed subject matter. These aspects are indicative, however, of but a few of the various ways, or embodiments, in which the principles of the disclosed subject matter may be implemented. The disclosed subject matter is intended to include all such embodiments and their equivalents. Other advantages and distinctive features of the disclosed subject matter will become apparent from the following detailed description of the various embodiments when considered in conjunction with the drawings.

The subject disclosure provides for aggregate provision and billing related to provisioning network access services and for network content to an application or device. In one or more disclosed aspects, the application or device (e.g., a client, . . . ) can be provided network access (e.g., Internet access, intranet access, Wi-Fi access, . . . ) at a discounted rate. The network access can be general access in some disclosed aspects, or can be limited access to one or more web-pages, domains, hosts, etc. Content consumed by the application or device can include charges for the content as well as charges for the network access, according to additional aspects. Aggregated charges can be applied to a subscriber account associated with the application or device, or can be applied to a provider of network access resources or a provider of network content consumed by the application or device, for charging a subscriber account associated with the application or device. The above-mentioned aspects of the disclosed subject matter can facilitate a relatively persistent connection to a network, with network access charges absorbed into charges for consumption of online content (e.g., multimedia content, media content, streaming content, downloaded content, and so forth) or utilization of online services (e.g., voice over Internet protocol [VoIP], analog or digital audio conferencing, video conferencing, online gaming, online shopping, and so on), or vice versa, or another suitable combination thereof.

According to further aspects of the subject disclosure, discounted network access can be acquired according to a limited-use offer. The limited-use offer can provide network access in a limited fashion in exchange for completion of a requirement by an application or device. The requirement can include downloading and playback of sponsored content (e.g., acquired from an advertising partner, . . . ), playback and viewing of an advertisement, completing a survey, applying for online shopping, registering a credit card with an online shopping service, completing an online purchase with a registered credit card, playing an online game, or the like, or a suitable combination thereof (e.g., registering a credit card for use with virtual currency within an online game, . . . ). Upon completion or the requirement or agreement to complete the requirement, the network access can be provided to the application or device.

According to one or more additional aspects, discounted network access or aggregated billing can be selectively implemented. An application or device can be configured to initiate the discounted network access in response to a first selection, or initiate separate network access and content consumption according to a second selection. This can give a user of the application or device a degree of flexibility with respect to network connectivity and content consumption, and how charges for the network connectivity and content consumption are billed. Accordingly, the application or device can facilitate user-centric control over costs associated with integrated network access and content acquisition.

In at least one embodiment, the subject disclosure provides a method. The method can comprise receiving, by a system comprising a processor, a network report of a request for network access resources initiated by an application or device, and receiving a content report of a request for network content initiated by the application or device. In addition to the foregoing, the method can comprise retrieving data to identify agreement data representing a stored combined billing agreement between a network operator transmitting the network report and a content provider transmitting the content report. Moreover, the method can comprise issuing a billing charge incorporating charges for consumption of the network access resources or charges for consumption of the network content per the combined billing agreement represented by the agreement data.

In another embodiment(s), the subject disclosure provides a system. The system can comprise a memory, coupled to a processor to facilitate execution of computer-executable components, to store the computer-executable components. Moreover, the system can comprise a reporting component configured to receive network messages via a network interface device from sets of network provisioning devices including one or more network access provider devices and one or more network content provider devices, wherein the network interface device is configured to receive or transmit data respectively from or to a set of network devices of a network. In one or more aspects of the embodiment(s), the system can comprise an integrated systems billing component configured to store rules related to aggregated billing for respective subsets of the sets of provisioning devices and a billing execution component configured to transmit billing for aggregated consumption of network content or network access resources of a subset of the sets of network provisioning devices to one or more entities identified by the rules related to aggregated billing. Further, the system can comprising a processing component configured to receive a first report of network access resources consumed in conjunction with fulfilling a subscriber request for an application or device and to receive a second report of network content consumed in conjunction with fulfilling the subscriber request. Alternatively, or in addition, the system can be configured to reference the rules to identify an aggregated charge for the network access resources consumed and the network content consumed and identify one of the one or more entities for assigning responsibility for payment of the aggregated charge.

In other embodiments, the present application discloses a non-transitory computer readable medium comprising computer-executable instructions that, in response to execution, cause a system comprising a processor to perform operations. The operations can comprise receiving a first report of a network access request by an application or device and a second report of a network content request by the application or device. Further, the operations can comprise referencing a stored set of aggregated billing rules configured to define aggregated charges for consumption of network access resources provided by a network access device and for consumption of network content provided by a network content device. In addition to the foregoing, the operations can comprise identifying an aggregated charge from the stored set of aggregated billing rules based on the first report and the second report and identify a single entity for payment of the aggregated charge, the single entity comprising one of the network access device, the network content device or the application or device.

The following description and the annexed drawings set forth in detail certain illustrative aspects of the disclosed subject matter. These aspects are indicative, however, of but a few of the various ways in which the principles of the disclosed subject matter can be employed and the disclosed subject matter is intended to include all such aspects and their equivalents. Other advantages and novel features of the disclosed subject matter will become apparent from the following detailed description when considered in conjunction with the drawings.

DETAILED DESCRIPTION

Figure 1:
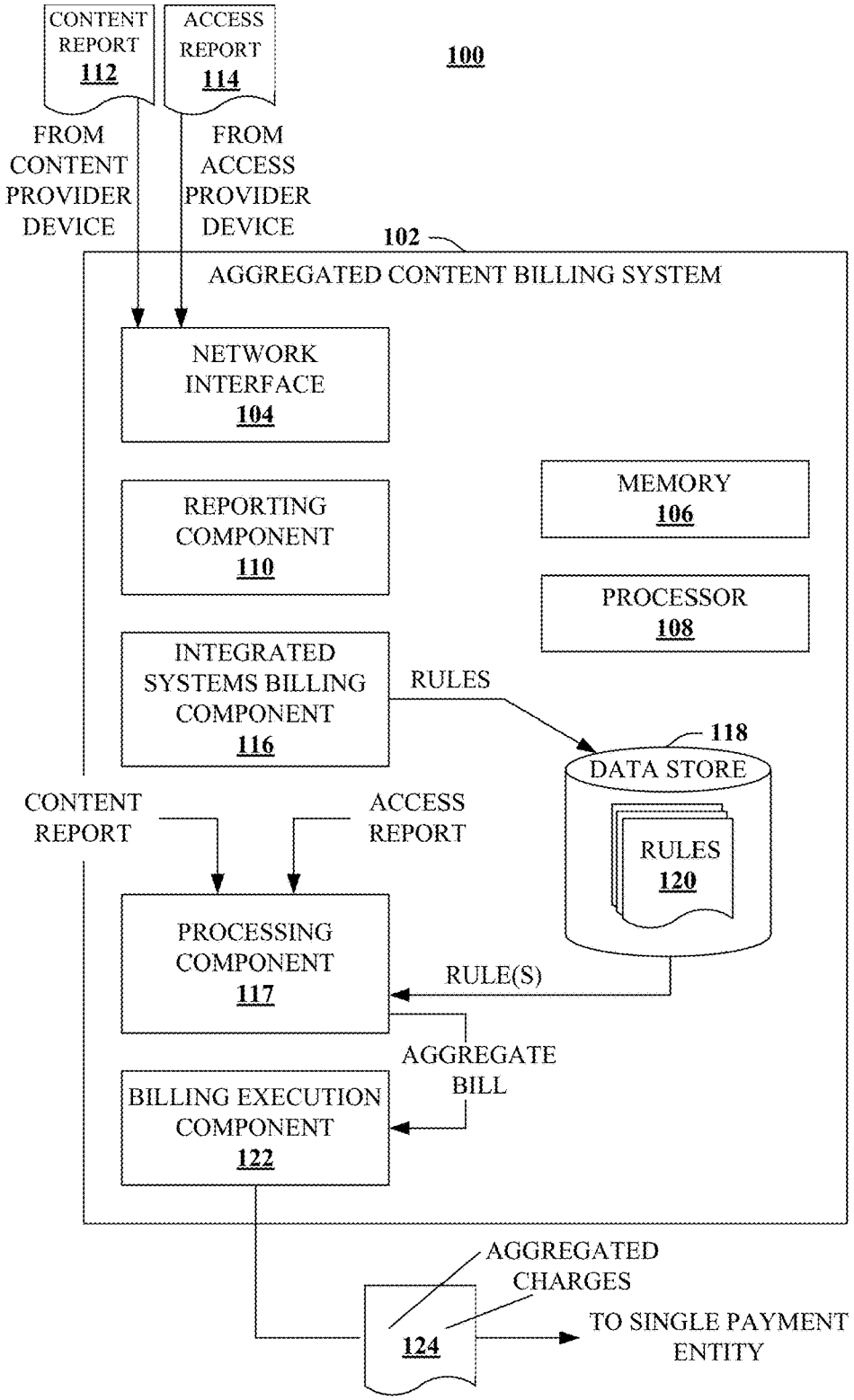
FIG. 1 illustrates a block diagram of an example system for aggregated billing in network communications according to embodiments of the subject disclosure.

The disclosed subject matter is described with reference to the drawings, wherein like reference numerals are used to refer to like elements throughout the description. In the following description, for purposes of explanation, numerous specific details are set forth in order to provide a thorough understanding of the subject innovation. It may be evident, however, that the disclosed subject matter may be practiced without these specific details. In other instances, well-known structures and devices are shown in block diagram or schematic form in order to facilitate describing various aspects disclosed herein.

Reference throughout this specification to "one embodiment," "an embodiment," "a disclosed aspect," or "an aspect" means that a particular feature, structure, or characteristic described in connection with the embodiment or aspect is included in at least one embodiment or aspect of the present disclosure. Thus, the appearances of the phrase "in one embodiment," "in one aspect," or "in an embodiment," in various places throughout this specification are not necessarily all referring to the same embodiment. Furthermore, the particular features, structures, or characteristics may be combined in any suitable manner in various disclosed embodiments.

As utilized herein, terms "component," "system," "module", "interface," "user interface", and the like are intended to refer to a computer-related entity, hardware, software (e.g., in execution), and/or firmware. For example, a component can be a processor, a process running on a processor, an object, an executable, a program, a storage device, and/or a computer. By way of illustration, an application running on a server and the server can be a component. One or more components can reside within a process, and a component can be localized on one computer and/or distributed between two or more computers.

Further, these components can execute from various computer readable media having various data structures stored thereon. The components can communicate via local and/or remote processes such as in accordance with a signal having one or more data packets (e.g., data from one component interacting with another component in a local system, distributed system, and/or across a network, e.g., the Internet, a local area network, a wide area network, etc. with other systems via the signal).

As another example, a component can be an apparatus with specific functionality provided by mechanical parts operated by electric or electronic circuitry; the electric or electronic circuitry can be operated by a software application or a firmware application executed by one or more processors; the one or more processors can be internal or external to the apparatus and can execute at least a part of the software or firmware application. As yet another example, a component can be an apparatus that provides specific functionality through electronic components without mechanical parts; the electronic components can include one or more processors therein to execute software and/or firmware that confer(s), at least in part, the functionality of the electronic components. In an aspect, a component can emulate an electronic component via a virtual machine, e.g., within a cloud computing system.

Since the advent of network-based computer services, challenges involved in delivering network services to a dynamic population of client devices have been a driving motive for the multiple-access server system. Such a system enables a population of client devices to request access to services independent from the server and independent from other client devices. Moreover, the server can allocate resources to facilitate network services for a particular client device independent of other client devices.

Though the basic problem of serving a dynamic population of client devices is well served by the multiple-access server system, many secondary challenges still remain. For instance, maximizing resource utilization for a dynamic population of client devices can be beneficial, yet difficult to achieve in practice. Moreover, serving high densities of client devices while avoiding service degradation can be a particularly challenging problem. Furthermore, the multiple-access server system does not have a convenient mechanism for discriminating network access (e.g., Internet access) among a set of applications of a communication device. Such discrimination might include, for instance, allocating resources of a data access network to a select application(s) of a communication device, while denying the allocated resources to other applications of the communication device. As utilized herein, a data access network is a network including one or more access points that facilitate electronic communication (whether wired or wireless) between a communication device and the data access network, or between the communication device and an external network. The data access network can be an Internet service provider (ISP) that provides the communication device access to the Internet, as one example. In another example, the data access network can be a mobile communication network that interconnects a communication device (e.g., a handheld device, a mobile phone, a computer with a mobile interface card, etc.) with other communication devices, with the public switched telephone network, or with other networks (e.g., the Internet, an intranet, and so on). In still other examples, the data access network can be an intranet comprising one or more network gateways to one or more networks external to the intranet. Other examples of a data access network known in the art or made known to one of ordinary skill in the art by way of the context provided herein are considered within the scope of the subject disclosure.

In various aspects of the subject disclosure, provided is an integrated network communication model that is content-centric, and interfaces client device applications with content provider network/devices (e.g., an online server, a network connected to the Internet or an intranet, and so on) over a data access network. Data access network communication resources can be allocated to content provider devices, which in turn utilize subsets of the communication resources in delivering network-based media content or services content (referred to herein in the aggregate as content) to communication devices. These communication devices can be a client of the data access network, in some disclosed aspects. In alternative or additional aspects, one or more applications operating on the communication devices can be a client of the content provider network/devices.

Billing for the integrated network communication model can also be integrated in some aspects. For instance, in some aspects data access network charges are bundled with the cost of accessing and consuming content. In alternative or additional aspects data access network charges and content charges can be separate.

As an example of the integrated network communication model, a service provider network or device (referred to herein generally as a service provider) can be given external control over some internal resources of a data access network in conjunction with employing the data access network to deliver content to an application operating on a device served by the data access network. This enables the service provider to provide adequate bandwidth, quality of service (QoS), bitrates, and so on, suitable for delivery and consumption of a particular class of content (e.g., high definition video content, audio content, web-browsing content, social media messaging content, . . . ), or suitable to match playback/operating capabilities of the application, and so forth, or suitable combinations thereof. This arrangement also opens up a mechanism to move away from a traditional client-ISP arrangement in which communication devices are clients of an ISP and pay the ISP for network access, and then employ the network access to communication with a content provider network (e.g., on the Internet). Rather, a client-content provider interaction can be implemented with the data access network serving the content service provider.

Referring now to the drawings, FIG. 1 illustrates a block diagram of an example aggregated content billing system 100, in one or more embodiments of the subject disclosure. Aggregated content billing system 100 can be configured to facilitate integration of network access and content services. As utilized herein, content services include delivery of media content (e.g., video, audio, pictures, . . . ), whether downloaded or streaming, browsing services (e.g., web-page browsing, and so on), communication services (e.g., voice over Internet protocol, network chat, video chat, audio-video calls, and the like), social media services, gaming services, and so on. Charges for content or services consumed can be compiled by aggregated content billing system 100. In at least some disclosed aspects, aggregated content billing system 100 can be configured to track access resources of a network access provider utilized and controlled by a content provider in conjunction with the content provider providing content services to a client of the content provider, or vice versa. In these latter aspects, aggregated content billing system 100 can store information pertaining to a shared billing agreement between the content provider and the network access provider to assign charges for consumption of content and access resources in conjunction with providing the content services to the client.

As depicted, aggregated content billing system 100 can comprise a network interface 104 configured to transmit data on a network(s), receive data on the network(s), or the like. Transmission or reception of data can be pursuant to instructions stored in a memory 106 and executed by a processor 108. Generally, memory 106 can be configured to store data, instructions, logic routines, or the like, pertaining to various components of aggregated content billing system 100. These data, instructions, logic routines, . . . , upon execution by processor 108 can facilitate performance of various functions described with respect to aggregated content billing system 100. It should be appreciated, however, that the data, instructions, logic routines, . . . , can be stored in multiple memories (not depicted) including memory 106, whether contained locally at aggregated content billing system 102 or distributed over a network, or executed by multiple processors (not depicted) including processor 108. Similar to the multiple memories, the multiple processors can be contained locally at aggregated content billing system 102 or distributed over a network.

In operation, a reporting component 110 can be configured to receive network messages via network interface 104 from a set of network provisioning devices. In various disclosed embodiments, the network messages can comprise a report(s) related to provisioning of network access resources to a client, or a report(s) related to provisioning of network content or network services (referred to hereinafter collectively as network content) over the network(s). The report(s) can be received from respective ones of a set of network provisioning devices, in some aspects. In other aspects, a first report of provisioning network access resources to the client and a second report of provisioning network content to the client can be transmitted by a single one of the set of network provisioning devices.

In one or more embodiments, an access report 114 indicative of a request for access resources, or consumption of the access resources, can be received at network interface 104 from a network access provider device. In this embodiment(s), the set of network provisioning devices can include the network access provider device. In other embodiments, a content report 112 indicative of a request for network content, or consumption of the network content, can be received at network interface 104 from a network content provider device. In these latter embodiments, the set of network provisioning devices can comprise the network content provider device. In some aspects, both access report 114 and content report 112 can be transmitted by one or more of a single type of provider (e.g., one or more network access provider devices, or one or more network content provider devices). This can occur, for instance, where the single type of provider is assigned control over resources or content of another type(s) of network provider. For instance, content or services of one or more network content provider devices can be controlled and assigned by one or more network access provider devices, or network access resources of one or more network access provider devices can be controlled and assigned by one or more network content provider devices. Such an arrangement can facilitate both provisioning access to a network(s) and delivery of network content over the network, by a network access provider device(s) or a network content provider device(s).

As mentioned above, content report 112 and access report 114 can be transmitted to aggregated content billing system 102 by a set of network provisioning devices in conjunction with providing network-related services to a client. The set of network provisioning devices can include, for instance, one or more network content provider devices or one or more network access provider devices. For various embodiments of the subject disclosure, examples of network access providers can include an Internet service provider (ISP), an intranet service provider (e.g., providing a Wi-Fi interface to a local area network or wide area network, among others), an ad-hoc network provider (e.g., a wireless device configured to interconnect nearby wireless communication terminals), or the like, or a suitable combination thereof. In these or other embodiments, examples of network content providers can include media content providers (e.g., television/movie content providers such as Netflix®, Hulu®, etc., Internet radio, and so forth), content browsing providers (e.g., web browsing devices), content download providers, network communication service providers (e.g., VoIP service providers, conference call devices, video chat devices, and so forth), online gaming providers, or the like, or a suitable combination thereof.

Further to the above, aggregated content billing system 102 can comprise an integrated systems billing component 116 configured to store rules related to aggregated billing for one or more subsets of the sets of provisioning devices. Data can be saved in an aggregated billing rules file 120 of a data store 118. Generally, the rules can indicate costs, charges, billing rates, etc., associated with consumption of content or services supplied by respective provisioning devices. Costs, charges, billing rates, etc., saved at aggregated billing rules file 120 for respective provisioning devices could include respective charges for network access resources consumed by a client application or device, and provided by respective ones of a first subset of the sets of provisioning devices, comprising one or more network access provider devices, for instance. As another example, costs for respective provisioning devices could include a cost or rate for network content consumed by the client application or device, and provided by a second subset of the sets of provisioning devices, comprising one or more network content provider devices. In addition, the rules can indicate costs, charges, billing rates, . . . , for additional subsets of the set of provisioning devices, comprising a combination of a network access provider device(s) and a network content provider device(s). These additional subsets can relate to, for instance, combined billing agreements between the network access provider(s) and network content provider(s). Combined billing agreements can identify combined costs, charges, billing rates, and so on, for network access resources provided by one or more network access provider devices of the additional subsets, in conjunction with network content provided by one or more network content provider devices. In some aspects, the combined billing agreements can indicate protocols for a network access provider device(s) to acquire and control resources of a network content provider device(s) in conjunction with providing network content over a network(s) to the client application or device, or protocols for the network content provider device(s) to acquire and control resources of the network access provider device(s) in conjunction with providing the network content over the network(s). Thus, combined billing agreements stored by aggregated billing rules file 120 can indicate respective resource charges (e.g., a first charge for network access resources and a second charge for network content resources) for resources originating at respective provisioning devices (e.g., a network access provider device and a network content provider device) and provided by one of the respective provisioning devices to the client application or device.

To facilitate billing for aggregated provisioning of resources, content report 112 can be transmitted by a content provider device and can include access report 114, or can be transmitted in conjunction with access report 114 by the content provider device. Accordingly, access resources of an access network provider device controlled or assigned by the content provider device in conjunction with providing combined network access and network content resources can be transmitted with content report 112 to aggregated content billing system 102. In alternative or additional aspects, access report 114 can be transmitted by a network access provider device and can include content report 112, or can be transmitted in conjunction with content report 112 by the network access provider device. In these aspects, content resources of a network content provider device controlled or assigned by the network access provider device in conjunction with providing the combined network access and network content resources can be transmitted with access report 114 to aggregated content billing system 102.

A processing component 117 can be configured to receive the content report and access report and determine network access resource consumption and content consumption related to providing network content to a client. The determination can be, for instance, derived from a metric of network access resources utilized for providing the network content, and a first cost for the network access resources, in addition to a metric of network content utilized for providing the network content, and a second cost for the network content. Processing component 117 can derive the metric of the network access resources from access report 114 and the metric of network content from content report 112 in some embodiments. In additional embodiments, the first cost and second cost can be obtained or derived from rules stored in rules file 120, associated with the combined billing agreement, to generate an aggregate charge for providing the network content. In at least one embodiment, a discount, reduction in cost, etc., can be applied to the aggregate charge as specified in the combined billing agreement, or a subscriber profile associated with the client, or the like, or a suitable combination thereof.

Upon determining charges for consumption of network content or network access resources, a billing execution component 122 can be configured to transmit billing for aggregated consumption of the network content or the network access resources of a subset of the sets of network provisioning devices. Further, billing execution component 122 can identify one or more entities from data stored in aggregated billing rules file 120 responsible for payment of the charges for consumption of network content or network access resources. Billing execution component 122 can further be configured to transmit an aggregated charges report 124 to the one or more entities. In one example, a combined billing agreement can indicate a client application or device consuming the network content and network access resources is responsible for payment thereof. In another example, the combined billing agreement can indicate a network content provider device controlling network access resources of a network access provider device is responsible for payment (or collecting payment) of the network content and network access resources. As yet another example, the combined billing agreement can indicate a network access provider device controlling network content resources of a network content provider device is responsible for payment (or collecting payment) of the network content and network access resources. Other combined billing arrangements can be stored in aggregated billing rules file 120 as well, and such combined billing agreements known in the art or made known to one of ordinary skill in the art by way of the subject disclosure are considered within the scope of the present description.

Figure 2:
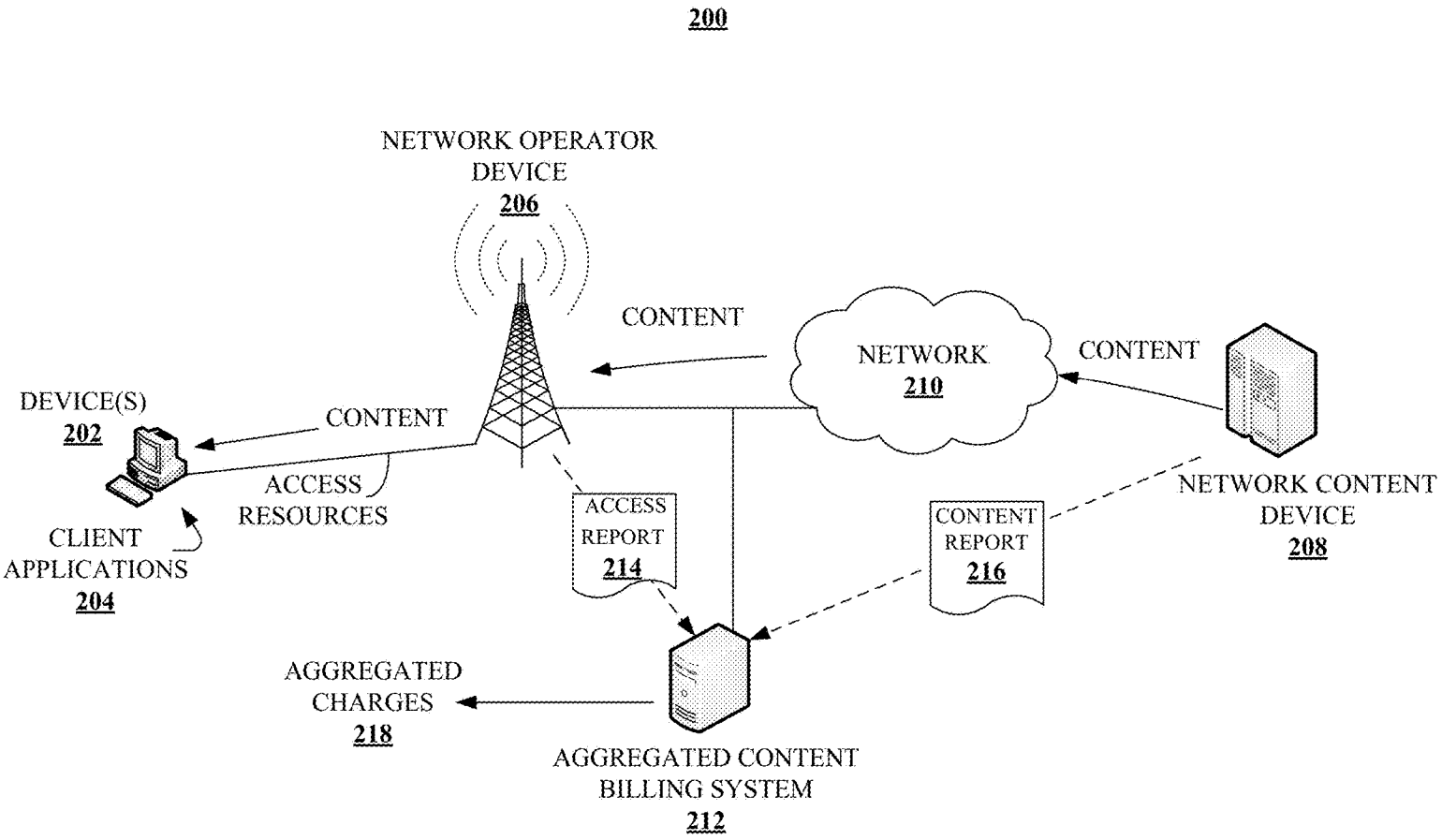
FIG. 2 depicts a block diagram of a sample network environment for facilitating aggregated billing in network communications, in an embodiment.

FIG. 2 illustrates a block diagram of an example network environment 200 according to various aspects of the subject disclosure. Network environment 200 can be configured to facilitate provisioning of aggregated network resources in conjunction with providing network content to a client. In addition, network environment 200 can be configured to track resources of separate network providers consumed in conjunction with providing the network content. Consumed resources of the separate network providers can be billed separately, or according to a billing agreement between the separate network providers.

As depicted, network environment can comprise one or more devices 202 comprising one or more client applications 204 operating on the device(s) 202. In some aspects, client application(s) 204 can be configured to employ communication components of device(s) 202 to access a network operator device 206. Network access resources can be assigned to device(s) 202 or client application(s) 204 by network operator device 206 to facilitate communication between client application(s) 204 and a network 210. Utilizing this communication, client application(s) 204 can contact a network content device 208 configured to provide network content over network 210. The network content can include media content, multimedia content, data content, browsing content, communication services, gaming services, social network services, and so on.

Upon connecting with network operator device 206, client application(s) 204 can utilize the network access resources to initiate acquisition of network content with network content device 208. Network operator device 206 can transmit an access services report 214 to an aggregated content billing system 212, indicating an amount, type, quality (e.g., quality of service [QoS]), etc., of the access resources assigned to device(s) 202 or client application(s) 204. Additionally, network content device 208 can transmit a network content report 216 indicating content requested by client application(s) 204 to aggregated content billing system 212. In at least one embodiment of the subject disclosure, aggregated content billing system 212 can be substantially similar to aggregated content billing system 102 of FIG. 1, supra. However, the subject disclosure is not so limited. In an alternative embodiment(s), network content device 208 can be configured to control a predetermined amount of access resources of network operator device 206, and assign a subset of the predetermined amount of access resources to client application(s) 204 in conjunction with delivering network content to client application(s) 204. In this embodiment(s), access services report 214 can optionally be prepared and transmitted to aggregated content billing system 212 by network content device 208 instead of network operator device 206. In yet another alternative embodiment(s), network operator device 206 can be configured to control a predetermined set of network content/resources of network content device 208 in conjunction with delivering the network content/resources to client application(s) 204. In this latter embodiment(s), network content report 216 can optionally be prepared and transmitted to aggregated content billing system 212 by network operator device 206.

Upon receiving access service report 214 and network content report 216, aggregated content billing system 212 can access stored billing information associated with providing network access resources of network operator device 206 or associated with providing network content of network content device 208. In one embodiment, total charges for consumption of access network resources and of network content can be compiled according to separate stored billing information associated with network operator device 206 and network content device 208. In another embodiment, the total charges can be determined from a billing agreement between network operator device 206 and network content device 208, where such a billing agreement is stored by aggregated content billing system 212. In a further embodiment, a subscriber account comprising stored subscriber information can be utilized to determine total charges, or to modify respective charges or aggregate charges as indicated by the subscriber information. For instance, where subscriber information indicates a discounted rate for access services (e.g., a free or reduced cost access to network 210 for a predetermined duration, at a predetermined QoS or amount of type of access resources, etc.) or a discounted rate for network content (e.g., a free or reduced cost for playback of a movie, a song, a music video, VoIP voice call, video call, and so on), and the discounted rate is selected at client application(s) 204, aggregated content billing system 212 can modify total charges according to the discounted rate.

Once determined, an aggregated charges report 218 is transmitted by aggregated content billing system 212. In some aspects of the subject disclosure, aggregated charges report 218 can be transmitted to client application(s) 204 directly, or applied to a subscriber account associated with client application(s) 204. In other aspects, for instance where network content and network access resources are provided to client application(s) 204 by either network operator device 206, or network content device 208, aggregated content billing system 212 can transmit aggregated charges report 218 to such entity (e.g., to network operator device 206 or network content device 208). In these latter aspects, a recipient of aggregated charges report 218 can assume responsibility for obtaining payment of aggregated charges, and apply a portion of payment to a partner device of a billing agreement. For example, where network operator device 206 assumes control of network content from network content device 208, payment for the network content as specified by the billing agreement can be obtained (e.g., from the subscriber account associated with client application(s) 204) and forwarded to an account associated with network content device 208. As another example, where network content device 208 assumes control of network access resources from network operator device 206 in conjunction with providing network content to client application(s) 204, payment for the network access resources can be obtained and forwarded to a second account associated with network operator device 206.

Figure 3:
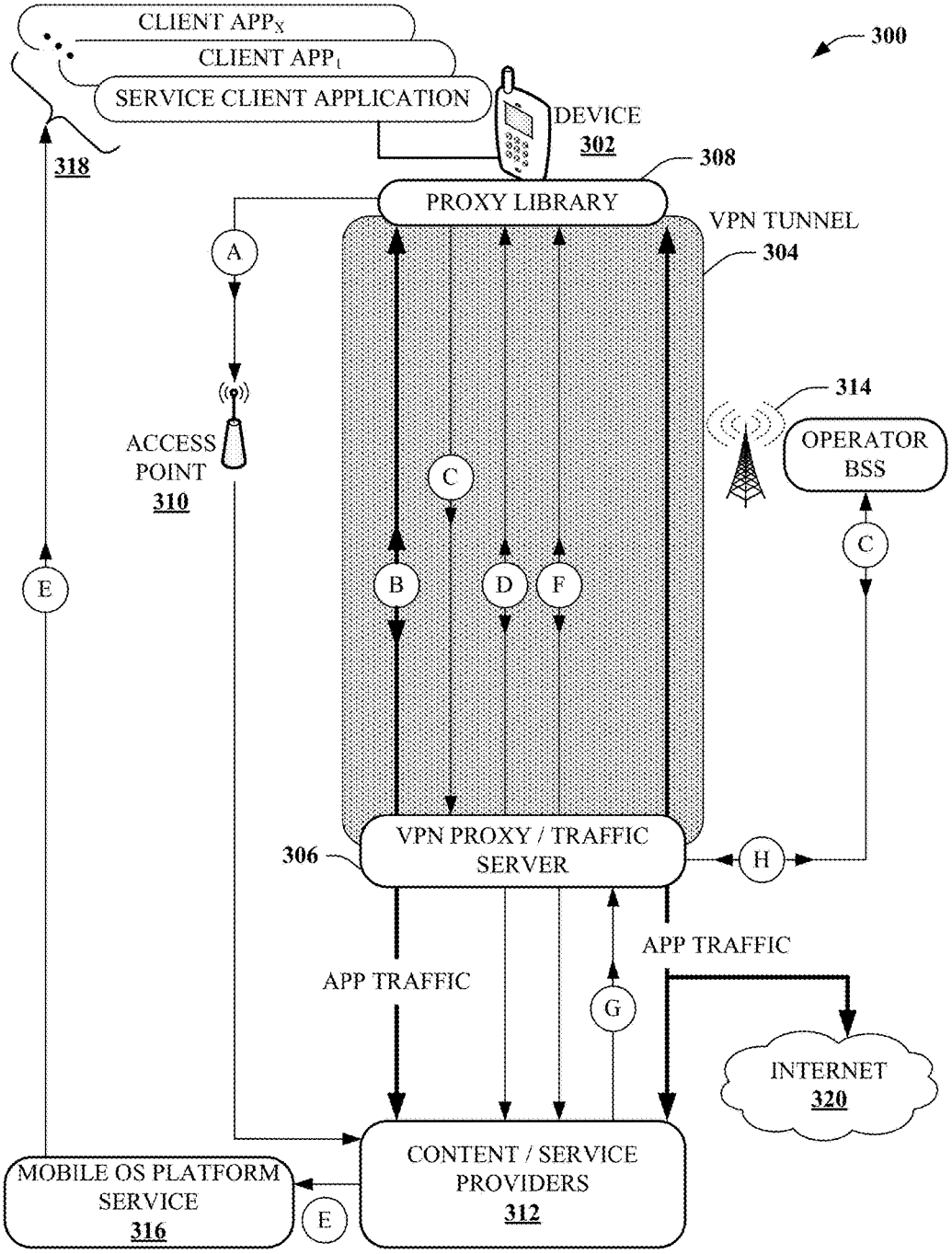
FIG. 3 illustrates a block diagram of an example system to facilitate integrated network access and content consumption in various disclosed aspects.

FIG. 3 depicts a block diagram of an example system 300 configured to facilitate provisioning of network content for applications operating on a communication device(s), according to one or more aspects of the subject disclosure. System 300 can comprise a device 302 that establishes a private communication tunnel, such as a virtual private network (VPN) tunnel 304 with a VPN proxy server 306. Device 302 can be configured to communicate with VPN proxy server 306 via wired communication (e.g., Ethernet, coaxial cable data line, twisted pair copper wire, broadband over power line, Firewire connection, and so on), or wireless communication (e.g., cellular communication, Wi-Fi communication, Bluetooth communication, personal wireless network, wireless microwave access, etc.), or a suitable combination thereof (e.g., wireless LAN connected to coaxial cable data line, among others). In some aspects, the private communication tunnel can be initiated at device 302 by a user thereof. In other aspects, the private communication tunnel can be initiated by a client application (e.g., see below) operating on device 302. The client application can initiate the private communication tunnel in response to activation of a network content function (e.g., a command to acquire and play network multimedia content, or to initiate a network communication service, or the like), as one example. In other aspects, the client application can be configured to periodically initiate the private communication tunnel, e.g., to acquire newly available content, or initiate the private communication tunnel in response to a signal received at device 302 (e.g., a command to initiate the private communication tunnel).

The VPN tunnel 304 can facilitate one of a plurality of communication models (whether wired or wireless) with a network content provider device(s) 312 enabling applications of device 302 to browse, access and receive content and services of the content provider device(s) 312. Device 302, VPN tunnel 304 and VPN proxy server 306 provide a basic communication framework for interconnecting applications (318) operating on device 302 with network content provider devices, as is described in more detail hereinafter.

In at least some aspects of the subject disclosure, system 300 can enable network content provider device(s) 312 to provide dedicated network access resources for communication devices. The dedicated network access resources can be limited to one or more client applications associated with a network content provider device 312, enabling the one or more client applications to access network content provider device(s) 312 (and, e.g., a network connected thereto), while preventing other applications from utilizing the dedicated network access resources, in some disclosed embodiments. In other embodiments, applications can generally utilize the dedicated network access resources, but in a limited fashion (e.g., a limited set of websites or webpages, a limited set of content, and so on). In various embodiments, however, the dedicated network access resources can facilitate providing online content or services for applications operating on the communication devices.

In various disclosed embodiments, limited access or utilization of the dedicated network access resources can incorporate constraints of access network operator devices providing the dedicated network access resources. Examples of such constraints can include, e.g., "zero balance", tariffs, network resource caps, and so on. In at least one aspect, such constraints can include disparate billing models for disparate communication models. For instance, one example billing model can comprise disparate access characteristics having different cost structures. In such an example, a preview-only access can facilitate access to a subset of content (e.g., a trailer or advertisement for content) at no charge free or reduced cost, whereas playback of the entire content can be at regular cost. As another example, a playback communication model can involve a tariff charged by the network access device in addition to costs for playback of content. Thus, the preview-only access can facilitate preview of content while the playback communication model can incorporate payment for playback of the content and the network access resources employed to deliver the content.

To facilitate content provision to multiple devices 302 from one or more network content provider devices 312, system 300 can be configured to distinguish traffic originating from a selected application on device 302 that is a client application of network content provider device 312 (e.g., a Facebook application being a client application of a Facebook server device, a Google® application being a client application of a Google server device, a YouTube® application being a client application of a YouTube server device, etc.) and an associated content provider network. Client applications can be allowed to utilize network access resources, while other applications are restricted from network access via the network access resources.

In some embodiments, to facilitate application-specific access to a particular network content provider device 312, VPN tunnel 304 can be established (e.g., utilizing layer two tunneling protocol [L2TP]/Internet Protocol Security [IPSEC] protocol, or other suitable secure communication protocol) from a client application 318 at device 302 to VPN proxy/traffic server 306. VPN proxy/traffic server 306 can then open an application programming interface (API) to an associated network content provider device 312. VPN proxy/traffic server 306 can then manage access to device 302 for the client application 318, and optionally restrict other applications of device 302 from communicating on VPN tunnel 304.

In at least one aspect, system 300 can be implemented according to processes A, B, C, D, E, F, G and H as depicted, to establish a VPN tunnel 304 and provide dedicated content to a client application(s) 318 of device 302. At process A, selection of a client application(s) 318 occurs at device 302, and proxy library 308 defines a limited network access (e.g., preview-only communication model) to an access point device 310 in response to the selection. Access point device 310 can be a wireless access point (e.g., wireless LAN, mobile radio access network [RAN], etc.), a wired access point (e.g., T1/T3 line network access device, coaxial cable network access device, digital subscriber line [DSL] network access device, . . . ), or a combination thereof. At process B, a user of device 302 initiates a service client application(s) 318 at device 302. In response to activation of service client application(s) 318, proxy library 308 generates VPN tunnel 304 between device 302 and VPN proxy/traffic server 306. For process B, the VPN tunnel 304 facilitates access only to a network content provider device 312 associated with service client application(s) 318, resulting in limited application traffic being exchanged between network content provider device 312 and device 302. At process C, a user of device 302 logs into a service at service client application(s) 318; a clientID for client device 302 is submitted for authorization by client device 302. At process D, an authorization check is performed on the client ID, and if successful, service client application(s) 318 solicits reduced cost/no cost limited access communication model. The reduced cost/no cost limited access communication can be forwarded to a mobile OS platform service 316, which forwards an operating system notification to client application(s) 318 of device 302. At process E, the user of device 302 can accept or reject the offer, utilizing a subscriber account to pay for fees (if any). If accepted, service client application(s) 318 sends a tunnelID to network content provider device 312. At process F the service client application(s) 318 activates network resources facilitating access to Internet 320 in response to accepting the reduced fee/no cost offer, and at process G network content provider device 312 requests Internet access/allocates Internet access resources for VPN tunnel 304 utilizing the tunnelID. At process H, VPN proxy/traffic server 306 opens access by tunnelID to the Internet 320 for a selected client application 318. Applications 318 other than the selected client application(s) 318 can be restricted, or consume traffic at normal billing rates (per ISP or mobile carrier billing arrangements).

Figure 4:
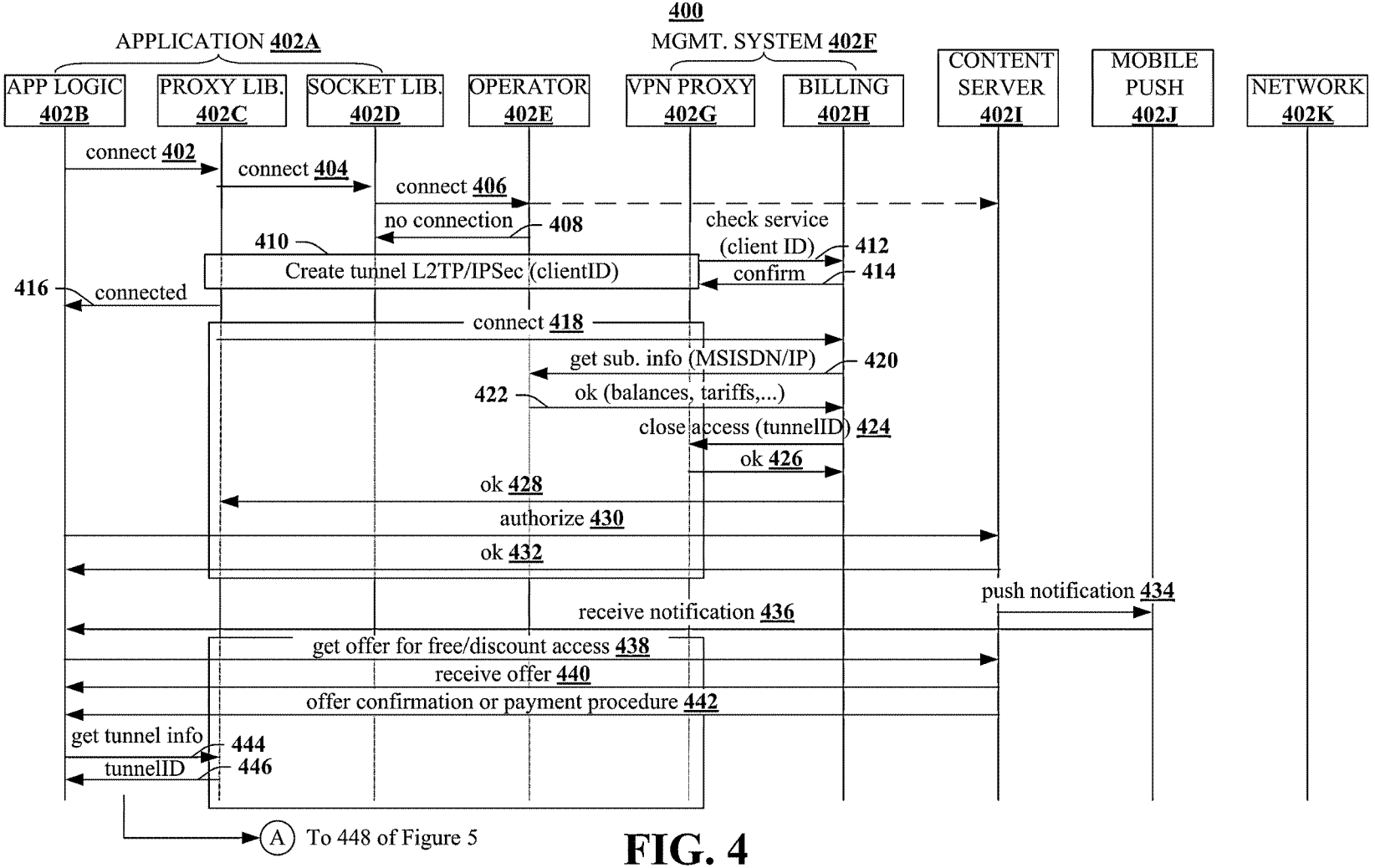
FIGS. 4 and 5 depict a block diagram of an example network process chart facilitating the integrated network access and content consumption.
Figure 5:
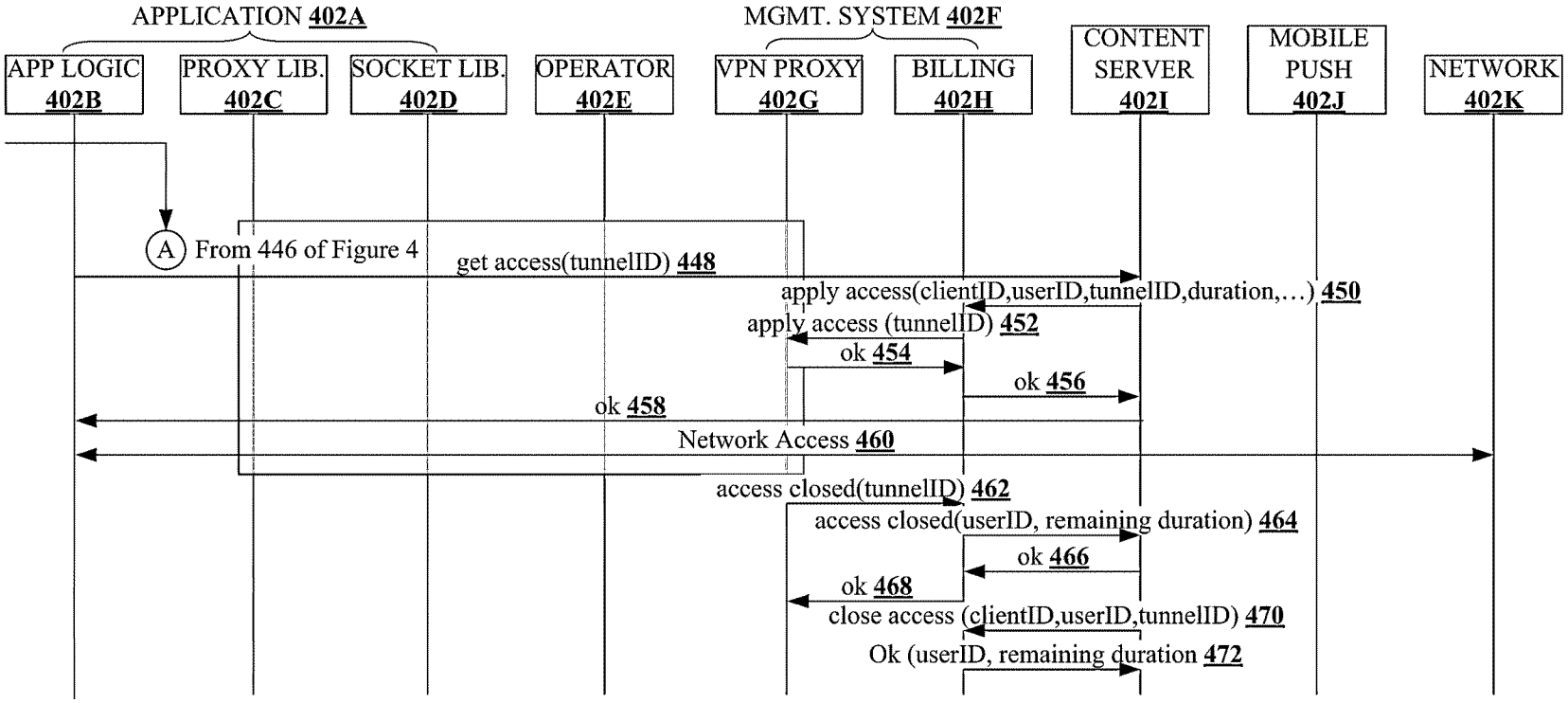

FIGS. 4 and 5 depict a block diagram of an example network system 400 that can facilitate network connectivity for a service application that is a client of a network content provider, according to one or more additional embodiments of the subject disclosure. Further, network system 400 can facilitate billing for consumption of network connectivity resources and network content in conjunction with accessing network content via the network connectivity. Network system 400 can comprise a client application 402A operating on a device (not depicted, but see, e.g., device 302 of FIG. 3, infra). In various aspects of the subject disclosure, client application 402A can comprise an application logic component 402B, a proxy library 402C and a socket library 402D. Additionally, client application 402A can utilize the device to communicatively connect with a network operator device 402E, and via the network operator device 402E communicate with a content server 402I. A resources management system 402F utilizing a VPN proxy 402G and billing component 402H can track consumption of communication resources of network operator device 402E in conjunction with content resources of content server 402I involved in the communication between application 402A and content server 402I. In some aspects, for instance where the device on which client application 402A is operating is a mobile communication device (e.g., a cell phone, mobile phone, smart phone, . . . ), network system 400 can comprise a mobile push component 402J, and in further aspects, network system 400 can comprise a connection to a data network 402K (e.g., the Internet, . . . ).

Network system 400 illustrates a set of communications between components of network system 400 as one example of implementing the provisioning of network content for client application 402A, and aggregated billing for the network content and network access resources consumed in providing the network content. Network system 400 can incorporate reduced cost or free network access as a further example. The reduced cost/free network access can be limited in time, duration, limited to a predetermined server, domain, webpage, host, Internet Protocol address, or the like, or a suitable combination thereof. Further, the set of communications can facilitate tracking resources consumed in association with the reduced cost/free network access and managing billing for separate service providers providing network access resources and network content resources associated with the provisioning of network content and the reduced cost/free network access. Other examples of component communications suitable for network system 400 for carrying these or similar activities can be utilized instead or in addition.

At 402, a connect command is issued by application logic component 402B to proxy library 402C. Proxy library 402C can issue the connect command 404 to socket library 402D, which can in turn issue the connect command 406 to network operator device 402E. Operator device 402E can optionally perform a reference check with content server 402I to identify whether an active communication between application 402A and content server 402I exists and, where no connection exists, a no connection notice 408 is sent to socket library 402D.

Proxy library 402C can be configured to initiate a communication tunnel request protocol 410 and provide a client ID to VPN proxy 402G of resources management system 402F with the communication tunnel request protocol 410. In at least one disclosed embodiment, initiating the communication tunnel request protocol 410 can comprise initiating a tunneling protocol, such as a layer 2 tunneling protocol/Internet Protocol Security [L2TP/IPSec]. Though subject disclosure can include other embodiments utilizing other tunneling or security protocols, however. VPN proxy 402G performs a check service command 412 with the client ID with billing component 402H. Upon confirmation of the check service command 412, a confirmation command 414 is sent by billing component 402H to VPN proxy 402G, which can then operate with application 402A to maintain the communication tunnel. Proxy library 402C sends a connection confirmation 416 to application logic 402B, and can be configured to send a connect request 418 to billing component 402H.

In response to receiving the connect request 418, billing component 402H can be configured to transmit a get subscriber information request 420 to operator device 402E. The get subscriber information request 420 can be configured, for instance, to acquire information related to the device, related to application 402A, or related to a subscriber account associated with the device or with application 402A, as some examples. In the general case, any suitable information for distinguishing the device, application 402A, an associated subscriber account, etc., from other such devices, applications, subscriber accounts, . . . , can be employed for the get subscriber information request 420. For instance, in the context of a mobile phone device, the get subscriber information request 420 can be configured to acquire mobile subscriber international subscriber directory number (MSISDN) information, Internet Protocol information, or the like. Operator device 402E can acknowledge the get subscriber information request 420 with an ok command 422. The ok command 422 can include information in response to the get subscriber information request 420. In addition, the ok command 422 can include tariff information for providing network access resources to application 402A. In some embodiments, ok command 422 can include existing account balance information related to application 402A, where suitable. In other embodiments, ok command 422 can include existing account balance information related to resources management system 402F or content server 402I (e.g., one or more of a set of subscribers served by resources management system 402F or content server 402I, which can include but need not be limited to application 402A). A combined billing agreement between operator device 402E and resources management system 402F or content server 402I could include stipulations for proceeding with authorization to give network access to application 402A. In some aspects, the stipulations for proceeding with authorization can be limited to use history, balance history, payment history, etc., of application 402A. In an alternative aspect, the stipulations can include use history, balance history, payment history, etc., of the set of subscribers served by resources management system 402F or content server 402I.

In response to ok command 422, billing component 402H can be configured to issue a close access command 424 to VPN proxy 402G, comprising the tunnelID. VPN proxy 402G can reply with an ok command 426, acknowledging the close access command 424. In some embodiments, network system 400 can condition authorization of access resources for communication between application 402A and content server 402I on account balance information, tariff information, or other information provided by operator device 402E to billing component 402H meeting one or more stipulations in a combined billing agreement. If such stipulations are not met, billing component 402H can deny provisioning of such resources.

In response to ok command 426 (and, e.g., in response to billing agreement stipulations being met, if applicable), billing component 402H can issue an ok command 428 to proxy library 402C. Proxy library 402C responds to ok command 428 by sending an authorization request 420 to content server 402I, which in turn responds with an ok command 432. In some embodiments, for example where the device is a mobile communication device and where operator device 402E is a mobile base station, cellular base station, or other suitable mobile network access gateway, content server 402I can issue a push notification 434 to mobile push component 402J, which can push a receive notification 436 to application logic 402B via a mobile network push communication.

In some embodiments, application 402A can include an option enabling a user of the device to request an offer related to acquiring free/discounted network access for communication with content server 402I. In such aspects, application logic 402B can issue a get offer related to acquiring free/discounted access 438 to content server 402I, in response to an input on the device selecting the option to request the offer. Application logic 402B can receive an offer 440 from content server 402I. The offer can comprise one or more suitable conditions performable on the device, on application 402A, another suitable application operating on the device, an action, input or interaction with a web page, web server, host, a network communication (e.g., a data input from application 402A transmitted to content server 402I or to network 402K), or the like, or a suitable combination thereof. Various examples of such an offer can include filling out a survey or survey questions, identified, linked, etc., in the receive offer 440, playback of content, such as media content, audio/video content (e.g., an advertisement, . . . ) on the device, providing input in response to the advertisement, performing an online purchase, registering an account with an online provider, or the like, or a suitable combination thereof. An offer confirmation/payment procedure 442 can be transmitted by content server 402I to application logic 402B. Offer confirmation/payment procedure 442 can be configured to verify acceptance and completion of the received offer 440 (e.g., playback of an advertisement, completion of a survey, registration verification of an online account, completion of an online purchase, . . . ), in some embodiments. In other embodiments, offer confirmation/payment procedure 442 can be configured to acquire a discounted payment from application 402A. These embodiments can be implemented, for example, where completion of the received offer 440 entitles application 402A to access to content from content server 402I at a discounted rate. In one or more other embodiments, offer confirmation/payment procedure 442 can be configured to acquire full payment for the content from application 402A. Acquisition of full payment can be implemented, for instance, where received offer 402 is rejected at application 402A, or where received offer 440 is not completed, cannot be verified, or the like.

Following offer confirmation/payment procedure 442, application logic 402B can transmit a get tunnel info request 444 to proxy library 402C. Get tunnel info request 444 can be configured to request information to establish a secure communication with content server 402I, for instance. Proxy library 402C can respond with tunnelID 446 to application logic 402B. Network system 400 is continued at FIG. 5, infra, at reference number 448.

Referring now to FIG. 5, network system 400 is depicted and continues the example communication described above. From respond with tunnelID 446 from proxy library 402C to application logic 402B, the communication can continue with application logic 402B issuing a get access command 448 comprising the tunnelID to content server 402I. Content server 402I can be configured to respond to the tunnelID with apply access 450 to billing component 402H. Apply access 450 can include information pertaining to application 402A (e.g., a clientID), information pertaining to a subscriber account associated with application 402A (e.g., a userID), the tunnelID, and information pertaining to content services provided for application 402A relevant for determining an amount or type of resources/resources consumed in conjunction with providing the content services. In one or more embodiments, the information can include duration of a communication link between content server 402I and application 402A, amount of data transferred from content server 402I as part of the communication link, or the like. In addition, for instance where content server 402I controls and assigns network access resources of operator device 402E as part of providing the content services, the information can include a metric related to an amount of the network access resources consumed (e.g., a bandwidth, a datarate, etc.), a type or quality of the network access resources (e.g., a jitter metric, a QoS metric, . . . ), a duration over which the network access resources are assigned to application 402A, and so forth.

Billing component 402H can respond to receiving the apply access 450 by forwarding apply access 452 comprising the tunnelID to VPN proxy 402G. In some embodiments, the apply access 452 can be conditioned on one or more conditions related to an account for application 402A (or a user/subscriber associated therewith). Suitable conditions can include whether any payment(s) are outstanding associated with a clientID, userID, or the like, whether offer conditions have been met (e.g., verification from a third party sponsor regarding completion of a task, etc.), whether suitable billing mechanism is associated with the account for application 402A (e.g., suitable credit on the account, status of an associated credit card or credit institution, and so on), or the like, or a suitable combination thereof. Upon satisfaction of any condition(s), billing component 402H can compete the forwarding apply access 452 in response to receiving apply access 450 according to these embodiments.

After receiving apply access 450, VPN proxy 402G can send an ok response 454 to billing component 402H. Billing component 402H can forward the ok response to content server 402I, and in turn content server 402I can forward the ok response to application logic 402B. Network access 460 is established between application logic 402B and network 402K, facilitating access to network 402K, or access to content server 402I. In some aspects, access to network 402K can be limited access (e.g., limited to a predetermined web page(s), web host(s), domain(s), or the like) or can be full access in other aspects.

Upon completion of network access 460, VPN proxy 402G can transmit an access closed command 462 to billing component 402H. The access closed command can include the tunnelID, in some embodiments. Billing component 402H can transmit an access closed command 464 comprising a userID and remaining duration information for network access 460, to content server 402I. Content server 402I can transmit an ok response 466 to billing component 402H, and terminate network access 460. Billing component 402H can forward an ok response 468 to VPN proxy 402G. Content server 402I can additionally transmit a close access command 470 comprising clientID, userID and tunnelID to billing component 402H. Billing component 402H can transmit an ok response 472 to content server 402I, including the userID and remaining duration for network access 460 to content server 402I.

Figure 6:
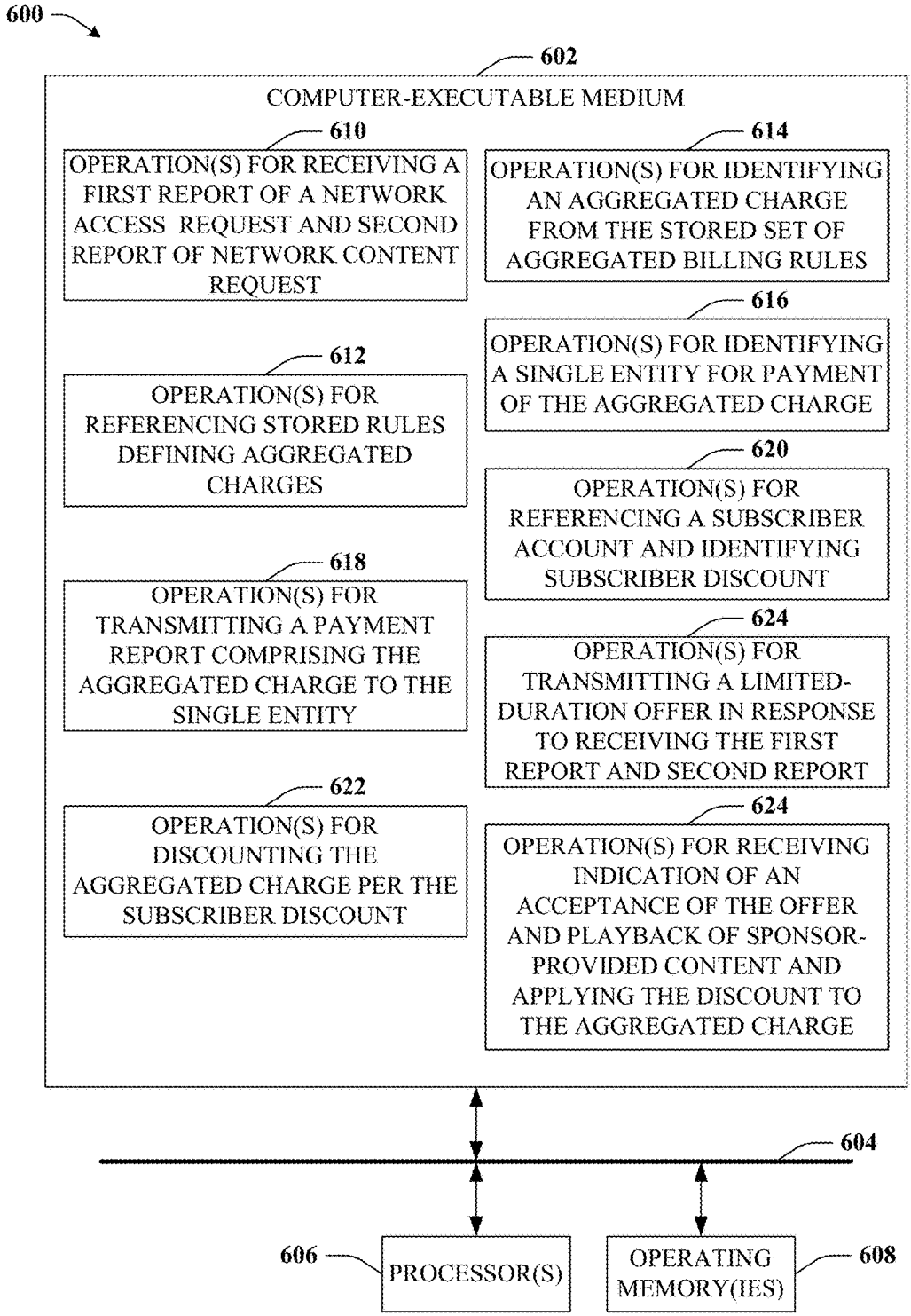
FIG. 6 depicts a block diagram of a sample system facilitating aggregated billing for integrated network access and content consumption.

FIG. 6 illustrates a block diagram of an example apparatus 600 for implementing one or more aspects of the subject disclosure. In one or more embodiments, apparatus 600 can be configured for providing aggregated billing for network access and provisioning of network content over a network. For instance, apparatus 600 can reside at least partially within a communication network or within a network server such as a network node, network gateway, terminal device, personal computer coupled with a network interface card, or the like. Apparatus 600 can be a distributed apparatus, in some embodiments, in which components of apparatus 600 are located in a plurality of remote devices configured for remote communication. The remote communication can be over a network, a bus, a wireless interface, or the like, or a suitable combination thereof. It is to be appreciated that apparatus 600 is represented as including functional blocks, which can be functional blocks that represent functions implemented by a hardware, software, or combination thereof (e.g., firmware). In some aspects, the functional blocks can represent non-transitory computer-executable media, such as a storage media, a volatile memory media, a non-volatile memory media, and so forth. In other aspects, the functional blocks can represent transitory computer-executable media such as a signal, a communication media, and so forth.

Apparatus 600 can comprise a computer-executable medium 602 comprising one or more computer-executable instructions that can be accessed over a data communication interface 604. Data communication interface 604 can include a communication bus, a media reader (e.g., disc reader, disk reader, driver reader, . . . ), a data ribbon, a wired data interface or data medium, a wireless data interface or data medium, a network communication interface, a network signaling interface, or the like, or a suitable combination thereof. Additionally, the computer-executable instructions can be stored in an operating memory(ies) 608 or executed by a processor(s) 606 to facilitate functionality of apparatus 600.

Computer-executable medium 602 can comprise an operation(s) 610 for receiving a first report of a network access request by an application or device and a second report of a network content request by the application or device. In addition, computer-executable medium 602 can comprise an operation(s) 612 for referencing a stored set of aggregated billing rules configured to define aggregated charges for consumption of network access resources provided by a network access device and for consumption of network content provided by a network content device. Further, computer-executable medium 602 can comprise an operation(s) 614 for identifying an aggregated charge from the stored set of aggregated billing rules based on the first report and the second report. In addition to the foregoing, computer-executable medium 602 can comprise an operation(s) 616 for identifying a single entity for payment of the aggregated charge. The single entity can comprise one of the network access device, the network content device or the application or device.

In some embodiments, computer-executable medium 602 can comprise an operation(s) 618 for transmitting a payment report comprising the aggregated charge to the single entity. In another embodiment(s), computer-executable medium 602 can comprise an operation(s) 620 for referencing a subscriber account associated with the application or device and for identifying a subscriber-related discount for the aggregated charge. According to a further embodiment(s), computer-executable medium 602 can comprise an operation(s) 622 for referencing a subscriber account associated with the application or device and identifying a subscriber-related discount for the aggregated charge. In additional embodiments, computer-executable medium 602 can comprise an operation(s) 624 for discounting the aggregated charge according to the subscriber-related discount and deriving a discounted aggregated charge, and transmitting a payment report reflecting the discounted aggregated charge to the single entity.

In alternative or additional embodiments of the subject disclosure, computer-executable medium 602 can comprise an operation(s) for transmitting a limited-duration offer to the application or device in response to receiving the first report and the second report, wherein the limited-duration offer comprises playback of sponsor-provided content at the application or device in exchange for a discount to the aggregated charge (e.g., providing reduced cost or free network access, where the network access can be full access or limited access as described herein). According to further embodiments, computer-executable medium 602 can comprise an operation(s) for receiving indication of an acceptance of the limited-duration offer and an indication of completion of the playback of sponsor-provided content by the application or device, and applying the discount to the aggregated charge according to the limited-duration offer in response to the indication of the acceptance of the limited-duration offer and in response to the indication of completion of the playback of sponsor-provided content.

The aforementioned diagrams have been described with respect to interaction between several systems, apparatuses, components, user interfaces, networks, network interfaces, or the like. It should be appreciated that such diagrams can include those components, networks or systems specified therein, some of the specified components/networks/systems or additional components/networks/systems. For example, network environment 200 could include aggregated content billing system 102, as one possible example. Sub-components could also be implemented as components electrically connected to other sub-components rather than included within a parent component. Additionally, it should be noted that two or more components could be combined into a single component providing aggregate functionality. For instance, integrated systems billing component 116 can include billing execution component 122 to facilitate storing rules related to aggregated billing and transmit billing for aggregated consumption of network content and network access resources, by way of a single component. Components of the disclosed systems, networks and apparatuses can also interact with one or more other components not specifically described herein but known by those of skill in the art, or made known to one of skill in the art by way of the context provided herein.

Figure 7:
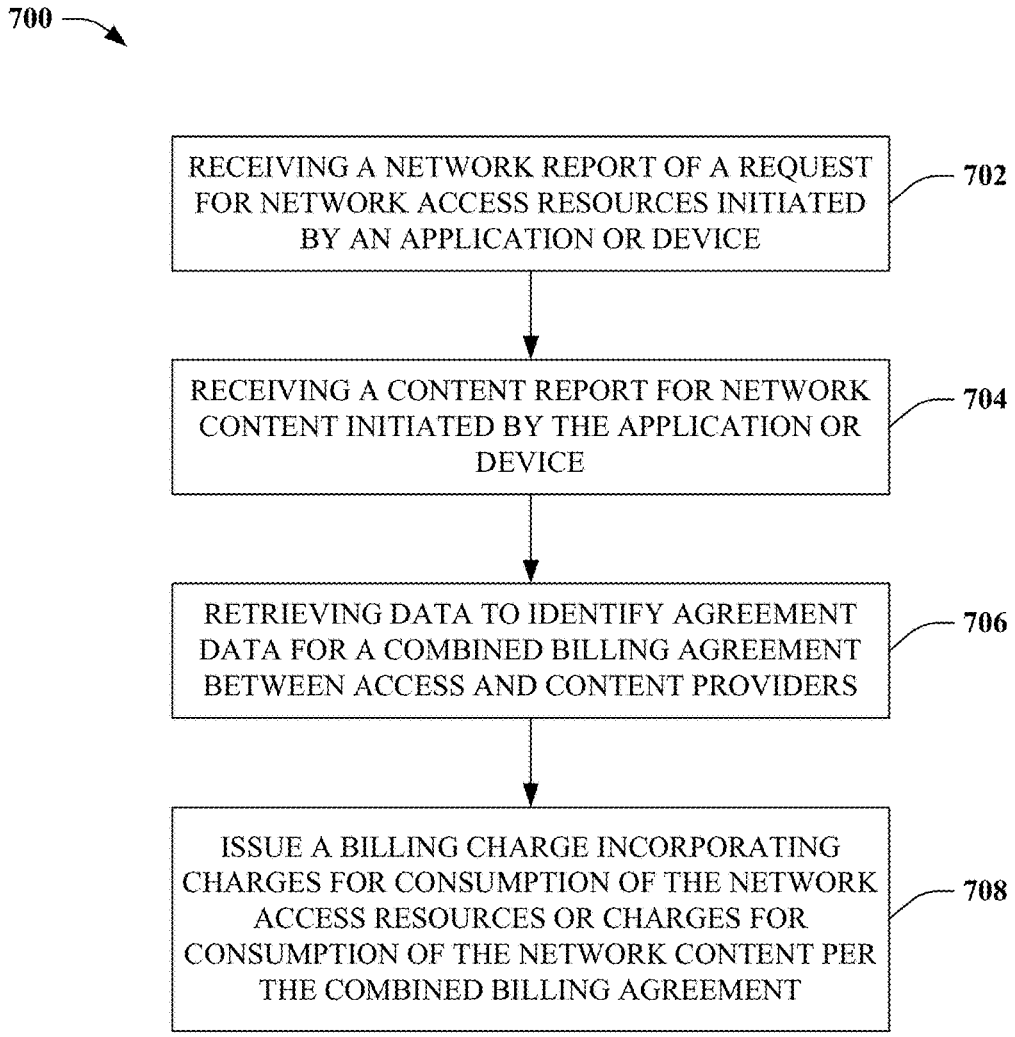
FIG. 7 illustrates a flowchart of a sample method for providing aggregate billing of network services, in one or more disclosed embodiments.
Figure 8:
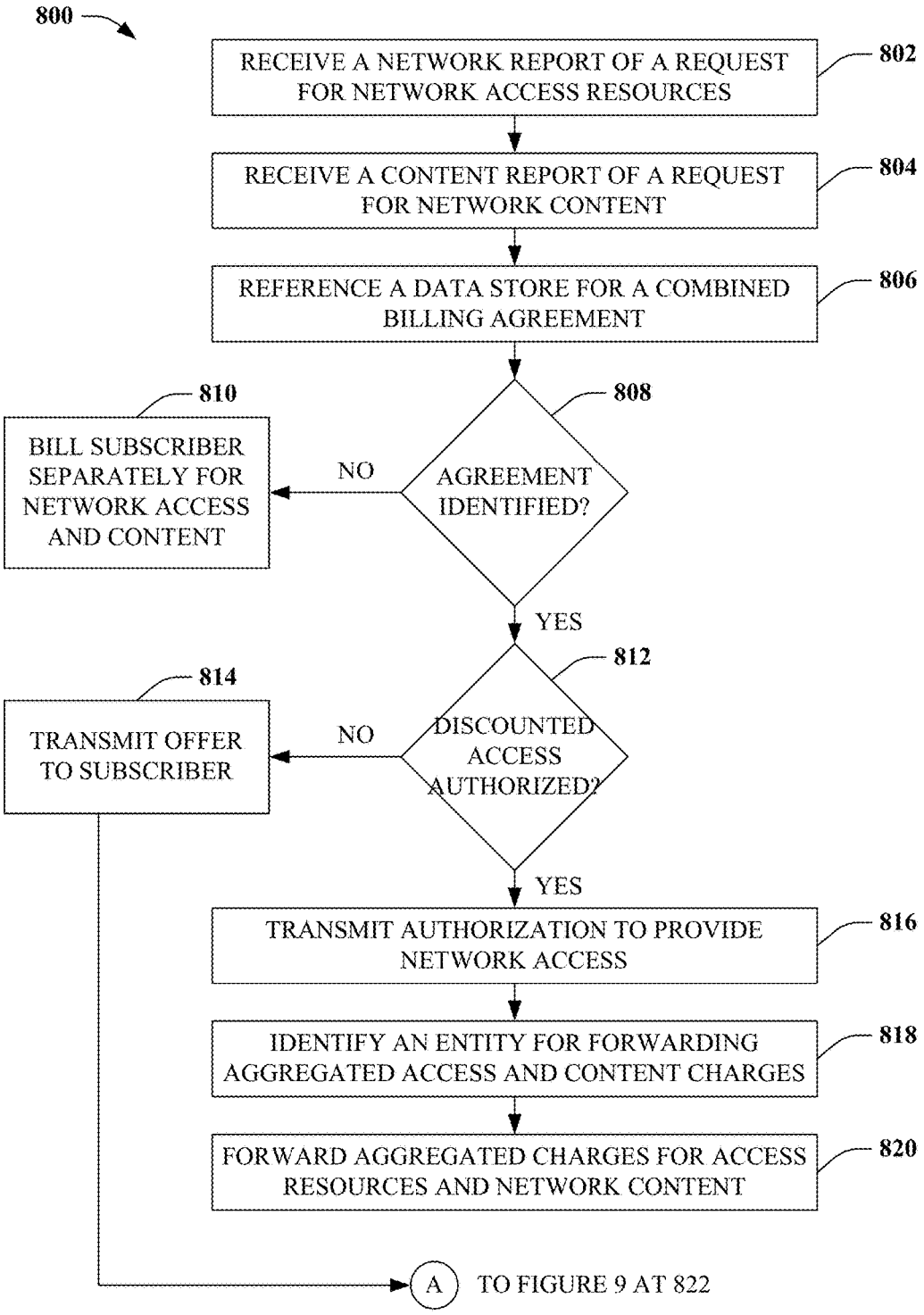
FIGS. 8 and 9 depict a flowchart of an example method for providing integrated network services and aggregate billing for the integrated services.
Figure 9:
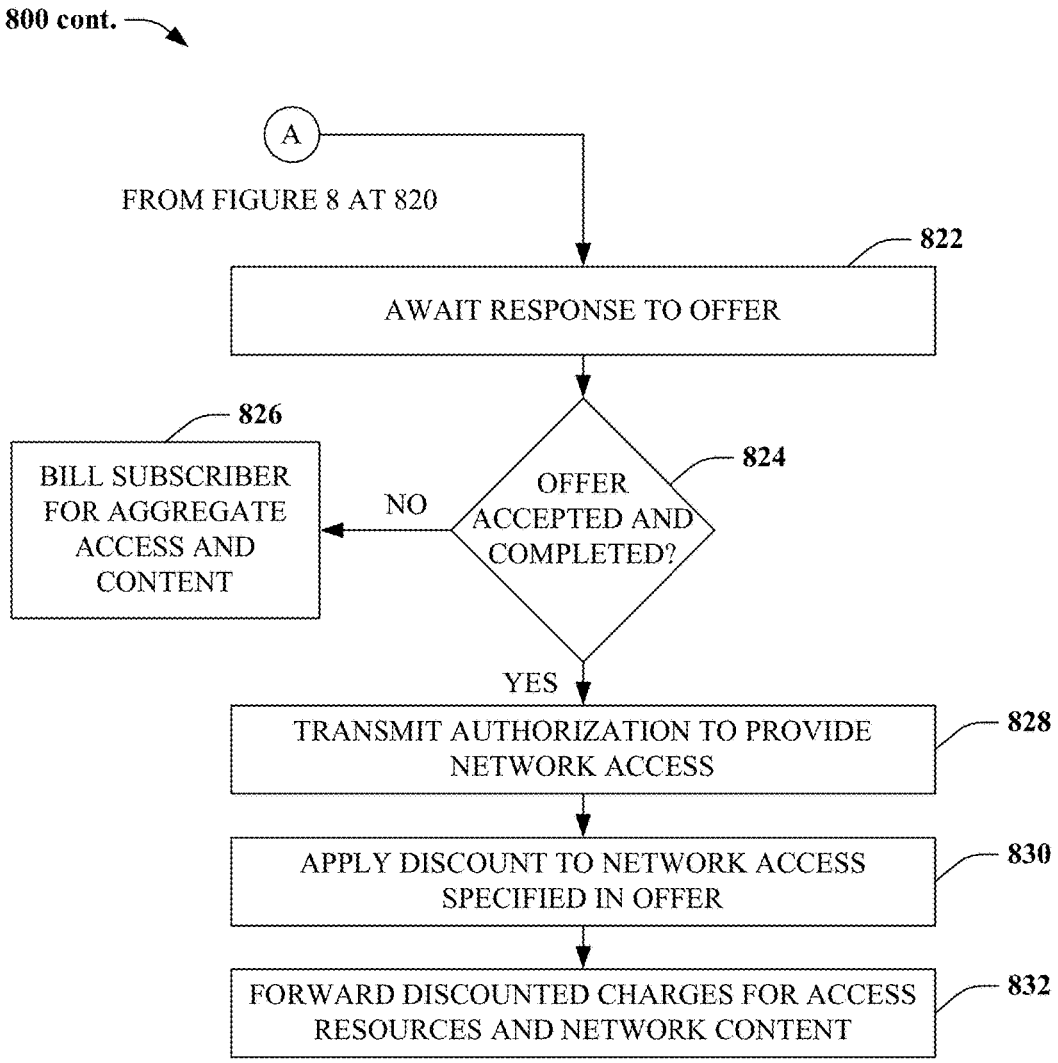

In view of the exemplary diagrams described supra, process methods that may be implemented in accordance with the disclosed subject matter will be better appreciated with reference to the flow charts of FIGS. 7, 8 and 9. While for purposes of simplicity of explanation, the methods are shown and described as a series of blocks, it is to be understood and appreciated that the disclosed subject matter is not limited by the order of the blocks, as some blocks may occur in different orders or concurrently with other blocks from what is depicted and described herein. Moreover, not all illustrated blocks may be required to implement the methods described herein. Additionally, it should be further appreciated that the methods disclosed herein are capable of being stored on an article of manufacture to facilitate transporting and transferring such methods to an electronic device. The term article of manufacture, as used, is intended to encompass a computer program accessible from any computer-readable device, device in conjunction with a carrier, or storage medium.

Referring now to FIG. 7, a flowchart of an example method 700 according to one or more aspects of the subject disclosure is depicted. Method 700 can comprise, at 702, receiving (e.g., by a system comprising a processor) a network report of a request for network access resources initiated by an application or device. At 704, method 700 can comprise receiving a content report of a request for network content initiated by the application or device. Further to the above, at 706, method 700 can comprise retrieving data (e.g., by performing a data lookup, etc.) to identify agreement data representing existence of a stored combined billing agreement between a network operator transmitting the network report and a content provider transmitting the content report. Moreover, at 708, method 700 can comprise issuing a billing charge incorporating charges for consumption of the network access resources or charges for consumption of the network content per the combined billing agreement represented by the agreement data.

FIGS. 8 and 9 illustrate a flowchart of a sample method 800 according to still other aspects of the subject disclosure. At 802, method 800 can comprise receiving a network report of a request for network access resources related to acquiring access for communication with a network. At 804, method 800 can comprise receiving a content report related to a request for network content. At 806, method 800 can comprise referencing a data store for a combined billing agreement. The combined billing agreement can be, for instance, information related to a provider of the network content and a provider of the network access resources. The agreement can provide network access resources of the provider of the network access resources for control by the provider of the network content, or vice versa, and associated costs, charges, etc. for the control of network access resources or network content, and rules, limitations, conditions, etc., for the control.

At 808, method 800 can comprise a determination as to whether the combined billing agreement is identified. If the combined billing agreement is identified, method 800 can proceed to 812. Otherwise, method 800 can proceed to 810.

At 810, method 800 can comprise billing a subscriber account separately for the network access and the network content. Method 800 can terminate following reference number 810.

At 812, method 800 can comprise a determination as to whether a discounted access is authorized by the combined billing agreement. If the discounted access is authorized, method 800 can proceed to 816. Otherwise, method 800 can proceed to 814. At 814, method 800 can comprise transmitting an offer related to the discounted access to an application or device requesting network access. From 814, method 800 can proceed to 822 at FIG. 9.

At 816, method 800 can comprise transmitting authorization to provide network access in response to the network report and the content report. At 818, method 800 can comprise identifying an entity for forwarding aggregated access and content charges associated with the network access. At 820, method 800 can comprise forwarding aggregated-charges for consumption of the network access resources and the network content to a subscriber account. Method 800 can terminate after forwarding the aggregated-charges for consumption of the network access resources and the network content.

Referring to FIG. 9, at 822 method 800 can comprise awaiting a response to the offer. At 824, method 800 can comprise a determination as to whether the offer is accepted and completed. If the offer is accepted and completed, method 800 can proceed to 828. Otherwise, method 800 can proceed to 826. At 826, method 800 can comprise billing a subscriber account for an aggregate charge of the network content and network access resources. Method 800 can terminate after reference number 826.

At 828, method 800 can comprise transmitting authorization to provide network access to the provider of the network access resources of the provider of the network content. At 830, method 800 can comprise applying a discount associated with the offer to the network access or the network content. At 832, method 800 can comprise forwarding the discounted aggregate charges for network access resources and network content to a subscriber account.

Figure 10:
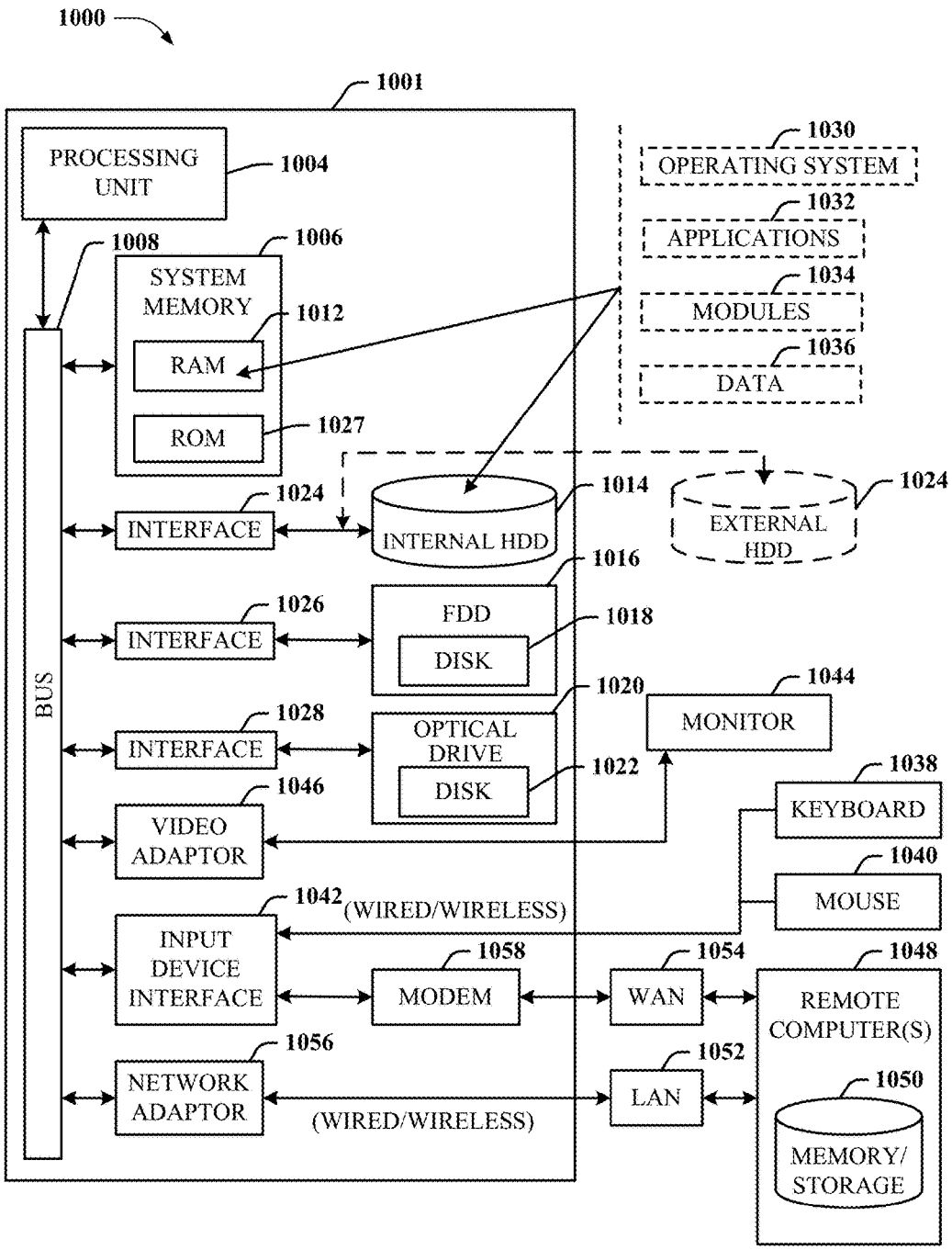
FIG. 10 illustrates a block diagram of an example computing environment to facilitate various aspects disclosed herein.

With reference to FIG. 10, an exemplary environment 1000 for implementing various aspects described herein includes a computer 1002, the computer 1002 including a processing unit 1004, a system memory 1006 and a system bus 1008. The system bus 1008 connects system components including, but not limited to, the system memory 1006 to the processing unit 1004. The processing unit 1004 can be any of various commercially available processors. Dual microprocessors and other multi-processor architectures can also be employed as the processing unit 1004.

The system bus 1008 can be any of several types of bus structure that can further interconnect to a memory bus (with or without a memory controller), a peripheral bus, and a local bus using any of a variety of commercially available bus architectures. The system memory 1006 includes read-only memory (ROM) 1010 and random access memory (RAM) 1012. A basic input/output system (BIOS) is stored in a non-volatile memory 1010 such as ROM, EPROM, EEPROM, which BIOS contains the basic routines that help to transfer information between elements within the computer 1002, such as during start-up. The RAM 1012 can also include a high-speed RAM such as static RAM for caching data.

The computer 1002 further includes an internal hard disk drive (HDD) 1014 (e.g., EIDE, SATA), which internal hard disk drive 1014 can also be configured for external use in a suitable chassis (not shown), a magnetic floppy disk drive (FDD) 1016, (e.g., to read from or write to a removable diskette 1018) and an optical disk drive 1020, (e.g., reading a CD-ROM disk 1022 or, to read from or write to other high capacity optical media such as the DVD). The hard disk drive 1014, magnetic disk drive 1016 and optical disk drive 1020 can be connected to the system bus 1008 by a hard disk drive interface 1024, a magnetic disk drive interface 1026 and an optical drive interface 1028, respectively. The interface 1024 for external drive implementations includes at least one or both of Universal Serial Bus (USB) and IEEE 1394 interface technologies. Other external drive connection technologies are within contemplation of the subject innovation.

The drives and their associated computer-readable media provide nonvolatile storage of data, data structures, computer-executable instructions, and so forth. For the computer 1002, the drives and media accommodate the storage of any data in a suitable digital format. Although the description of computer-readable media above refers to a HDD, a removable magnetic diskette, and a removable optical media such as a CD or DVD, it should be appreciated by those skilled in the art that other types of media which are readable by a computer, such as zip drives, magnetic cassettes, flash memory cards, cartridges, and the like, can also be used in the exemplary operating environment, and further, that any such media can contain computer-executable instructions for performing the methods of the disclosed innovation.

A number of program modules can be stored in the drives and RAM 1012, including an operating system 1030, one or more application programs 1032, other program modules 1034 and program data 1036. All or portions of the operating system, applications, modules, and/or data can also be cached in the RAM 1012. It is to be appreciated that aspects of the subject disclosure can be implemented with various commercially available operating systems or combinations of operating systems.

A user can enter commands and information into the computer 1002 through one or more wired/wireless input devices, e.g., a keyboard 1038 and a pointing device, such as a mouse 1040. Other input devices (not shown) may include a microphone, an IR remote control, a joystick, a game pad, a stylus pen, touch screen, or the like. These and other input devices are often connected to the processing unit 1004 through an input device interface 1042 that is coupled to the system bus 1008, but can be connected by other interfaces, such as a parallel port, an IEEE 1394 serial port, a game port, a USB port, an IR interface, etc.

A monitor 1044 or other type of display device is also connected to the system bus 1008 through an interface, such as a video adapter 1046. In addition to the monitor 1044, a computer typically includes other peripheral output devices (not shown), such as speakers, printers, etc.

The computer 1002 can operate in a networked environment using logical connections by wired and/or wireless communications to one or more remote computers, such as a remote computer(s) 1048. The remote computer(s) 1048 can be a workstation, a server computer, a router, a personal computer, portable computer, microprocessor-based entertainment appliance, a peer device or other common network node, and typically includes many or all of the elements described relative to the computer 1002, although, for purposes of brevity, only a memory/storage device 1050 is illustrated. The logical connections depicted include wired/wireless connectivity to a local area network (LAN) 1052 and/or larger networks, e.g., a wide area network (WAN) 1054. Such LAN and WAN networking environments are commonplace in offices and companies, and facilitate enterprise-wide computer networks, such as intranets, all of which may connect to a global communications network, e.g., the Internet.

When used in a LAN networking environment, the computer 1002 is connected to the local network 1052 through a wired and/or wireless communication network interface or adapter 1056. The adapter 1056 may facilitate wired or wireless communication to the LAN 1052, which may also include a wireless access point disposed thereon for communicating with the wireless adapter 1056.

When used in a WAN networking environment, the computer 1002 can include a modem 1058, or can be connected to a communications server on the WAN 1054, or has other means for establishing communications over the WAN 1054, such as by way of the Internet. The modem 1058, which can be internal or external and a wired or wireless device, is connected to the system bus 1008 through the serial port interface 1042. In a networked environment, program modules depicted relative to the computer 1002, or portions thereof, can be stored in the remote memory/storage device 1050. It will be appreciated that the network connections shown are exemplary and other means of establishing a communications link between the computers can be used.

The computer 1002 is operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This includes at least Wi-Fi® and Bluetooth™ wireless technologies. Thus, the communication can be a predefined structure as with a conventional network or simply an ad hoc communication between at least two devices.

Wi-Fi, allows connection to the Internet from a couch at home, a bed in a hotel room, or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, n, etc.) to provide secure, reliable, fast wireless connectivity. A Wi-Fi network can be used to connect computers to each other, to the Internet, and to wired networks (which use IEEE 802.3 or Ethernet). Wi-Fi networks operate in the unlicensed 2.4 and 5 GHz radio bands, at an 11 Mbps (802.11a) or 54 Mbps (802.11b) data rate, for example, or with products that contain both bands (dual band), or other bands (e.g., 802.11g, 802.11n, . . . ) so the networks can provide real-world performance similar to the basic 10BaseT wired Ethernet networks used in many offices.

Figure 11:
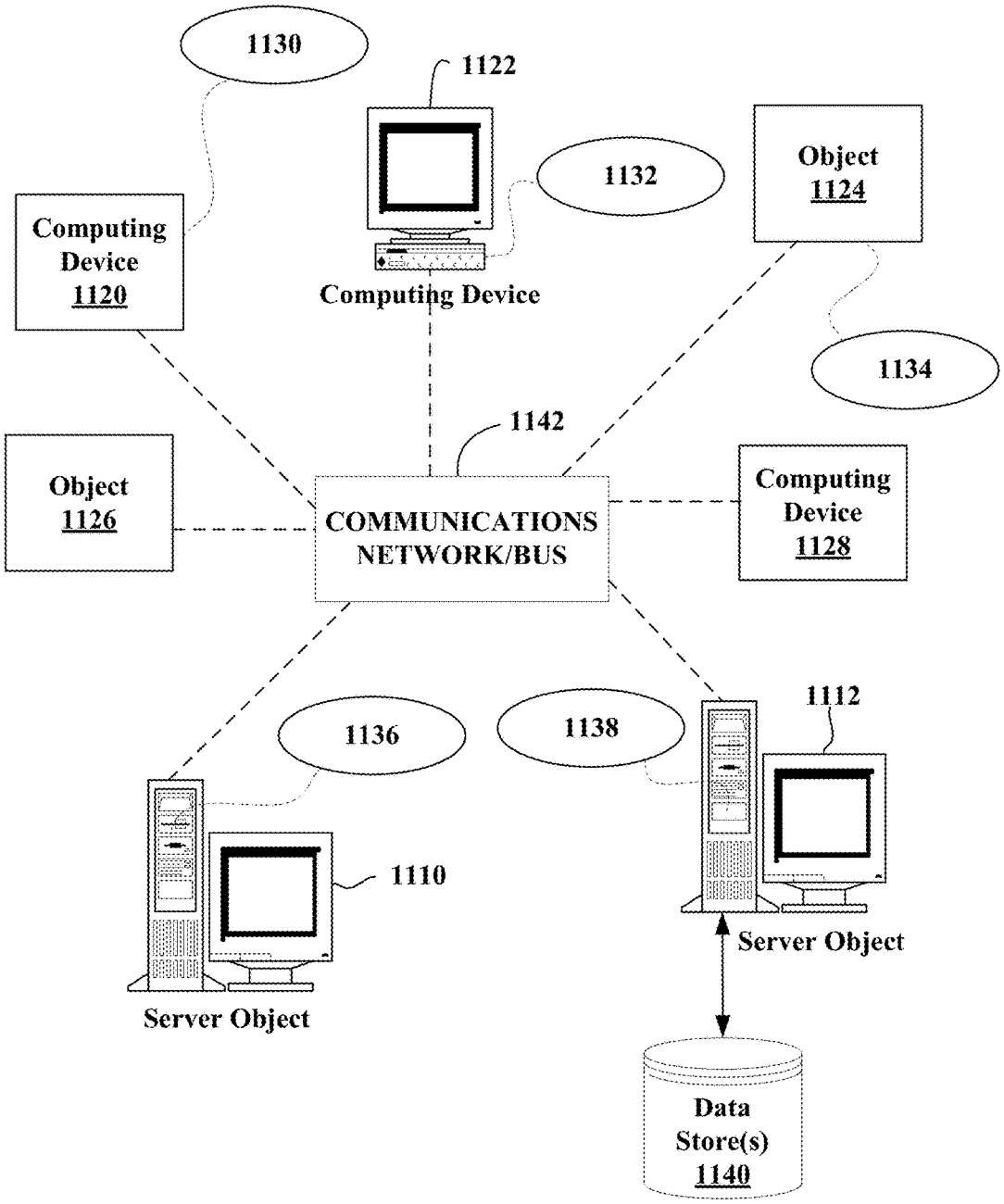
FIG. 11 depicts a block diagram of a sample network environment to facilitate remote communication according to still other disclosed aspects

FIG. 11 provides a schematic diagram of an exemplary networked or distributed computing environment. The distributed computing environment comprises server objects 1110, 1112, etc. and computing devices or objects 1120, 1122, 1124, 1126, 1128, etc., which may include programs, methods, data stores, programmable logic, etc., as represented by applications 1130, 1132, 1134, 1136, 1138 and data store(s) 1140. It can be appreciated that server objects 1110, 1112, etc. and computing devices or objects 1120, 1122, 1124, 1126, 1128, etc. may comprise different devices, including network operator device 206, aggregated content billing system 102, 112, content server 208, or similar entities depicted within the illustrations, or other devices such as a network-enabled display device, network-enabled television, set-top box with network connection and display, satellite receiver and display, mobile phone, personal digital assistant (PDA), audio/video device, MP3 players, personal computer, laptop, etc. It should be further appreciated that data store(s) 1240 can include data store 118, or another similar data store.

Each server object 1110, 1112, etc. and computing devices or objects 1120, 1122, 1124, 1126, 1128, etc. can communicate with one or more other server objects 1110, 1112, etc. and computing devices or objects 1120, 1122, 1124, 1126, 1128, etc. by way of the communications network 1142, either directly or indirectly. Even though illustrated as a single element in FIG. 11, communications network 1142 may comprise other computing objects and computing devices that provide services to the system of FIG. 11, or may represent multiple interconnected networks, which are not shown. Each server object 1110, 1112, etc. or computing device or object 1120, 1122, 1124, 1126, 1128, etc. can also contain an application, such as applications 1130, 1132, 1134, 1136, 1138, that might make use of an API, or other object, software, firmware or hardware, suitable for communication with or implementation of the techniques for search augmented menu and configuration functions provided in accordance with various embodiments of the subject disclosure.

There is a variety of systems, components, and network configurations that support distributed computing environments. For example, computing systems can be connected together by wired or wireless systems, by local networks or widely distributed networks. Currently, many networks are coupled to the Internet, which provides an infrastructure for widely distributed computing and encompasses many different networks, though any network infrastructure can be used for exemplary communications made incident to the systems for search augmented menu and configuration functions as described in various embodiments.

Thus, a host of network topologies and network infrastructures, such as client/server, peer-to-peer, or hybrid architectures, can be utilized. One or more of these network topologies can be employed by aggregated content billing system 102, device(s) 202, client application(s) 204, or network operator device 206, network content device 208, network 210, and others, for communicating with a network. The "client" is a member of a class or group that uses the services of another class or group to which it is not related. A client can be a process, e.g., roughly a set of instructions or tasks, that requests a service provided by another program or process. The client process utilizes the requested service, in some cases without having to "know" any working details about the other program or the service itself. A client device can be a computing device or object 1120, 1122, 1124, 1126, 1128 upon which a client process operates or is executed, in one or more disclosed aspects.

In a client/server architecture, such as a networked system, a client is usually a computer that accesses shared network resources provided by another computer, e.g., a server. In the illustration of FIG. 11, as a non-limiting example, computing devices or objects 1120, 1122, 1124, 1126, 1128, etc. can be thought of as clients and server objects 1110, 1112, etc. can be thought of as servers where server objects 1110, 1112, etc., acting as servers provide data services, such as receiving data from client computing devices or objects 1120, 1122, 1124, 1126, 1128, etc., storing of data, processing of data, transmitting data to client computing devices or objects 1120, 1122, 1124, 1126, 1128, etc., although any computer can be considered a client, a server, or both, depending on the circumstances.

A server is typically a remote computer system accessible over a remote or local network, such as the Internet or wireless network infrastructures. The client process may be active in a first computer system, and the server process may be active in a second computer system, communicating with one another over a communications medium, thus providing distributed functionality and allowing multiple clients to take advantage of the information-gathering capabilities of the server. Any software objects utilized pursuant to the techniques described herein can be provided standalone, or distributed across multiple computing devices or objects.

In a network environment in which the communications network 1142 or bus is the Internet, for example, the server objects 1110, 1112, etc. can be Web servers with which other computing devices or objects 1120, 1122, 1124, 1126, 1128, etc. communicate via any of a number of known protocols, such as the hypertext transfer protocol (HTTP). Server objects 1110, 1112, etc. acting as servers may also serve as clients, e.g., computing devices or objects 1120, 1122, 1124, 1126, 1128, etc., as may be characteristic of a distributed computing environment.

The subject matter described herein can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, computer-readable carrier, or computer-readable media. For example, computer-readable media can include, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media.

The word "exemplary" where used herein means serving as an example, instance, or illustration. For the avoidance of doubt, the subject matter disclosed herein is not limited by such examples. In addition, any aspect, embodiment or design described herein as "exemplary", "demonstrative", "illustrative", or the like, is not necessarily to be construed as preferred or advantageous over other aspects or designs, nor is it meant to preclude equivalent exemplary structures and techniques known to those of ordinary skill in the art.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification schemes and/or systems (e.g., support vector machines, neural networks, expert systems, Bayesian belief networks, fuzzy logic, and data fusion engines) can be employed in connection with performing automatic and/or inferred action in connection with the disclosed subject matter.

Furthermore, to the extent that the terms "includes," "has," "contains," and other similar words are used in either the detailed description or the appended claims, such terms are intended to be inclusive—in a manner similar to the term "comprising" as an open transition word—without precluding any additional or other elements. Moreover, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A method, comprising:

allocating, by a system comprising a processor, network access resources of a communication network to a device;

facilitating establishment of a private communication channel between an application operating on the device and a communication server that controls access to a content server of a network content provider, wherein the private communication channel is restricted from a second application operating on the device;

facilitating consumption of media content by the device, the media content delivered over the private communication channel from the content server at least in part by way of the network access resources;

receiving, by the system, a consumption report pertaining to the network access resources and the media content;

retrieving, from the consumption report, first data representing a content report indicating the media content consumed at the device or the application operating on the device;

retrieving, from the consumption report, second data representing a network report of the network access resources provided for the application and restricted from the second application operating on the device in conjunction with consumption of the media content at the application or the device;

retrieving agreement data representing existence of a stored combined billing agreement between a network operator associated with the communication network and providing the network access resources to the application and restricted from the second application and a content provider facilitating transmission of the media content to the application or device;

compiling network access billing data from the first data incorporating charges for consumption of the network access resources and content billing data from the second data incorporating charges for consumption of the media content per the combined billing agreement represented by the agreement data; and at least one of:

issuing a combined billing statement comprising the network access billing data and the content billing data in response to the agreement data indicating combined billing, or issuing separate billing statements respectively comprising the network access billing data and the content billing data in response to the agreement data indicating separate billing.

2. The method of claim 1, wherein retrieving the agreement data comprises retrieving rule data representing combined billing rules for the network operator and the content provider in conjunction with issuing the combined billing statement.

3. The method of claim 1, further comprising referencing a client data file comprising billing information pertaining to the application or device, in response to receiving the network report or the content report.

4. The method of claim 3, further comprising identifying modification data within the client data file indicative of a subscriber account modification to a default billing arrangement under the combined billing agreement.

5. The method of claim 4, wherein the modification data includes a client device preference for the combined billing statement or for the separate billing statements, and further comprising incorporating the subscriber account modification to the charges for consumption of the network access resources or the charges for consumption of the media content in conjunction with compiling the network access billing data and the content billing data.

6. The method of claim 1, wherein issuing the separate billing statements further comprises generating a media content billing statement comprising charges for the consumed media content and an access network billing statement comprising charges for the network access resources, wherein the network access resources are provisioned to the application and restricted from the second application only for consumption of the media content.

7. The method of claim 1, further comprising transmitting one or more of the separate billing statements directly to the application or device to facilitate issuing the separate billing statements.

8. The method of claim 1, further comprising transmitting one or more of the separate billing statements to the content provider to facilitate issuing the separate billing statements to the application or device.

9. The method of claim 1, wherein the issuing the combined billing statement further comprises aggregating charges for consumed media content and charges for consumed access network resources provisioned to the application only for the consumed media content and restricted from the second application.

10. The method of claim 1, further comprising transmitting the combined billing statement to the content provider in accordance with the combined billing agreement.

11. The method of claim 1, further comprising transmitting the combined billing statement to the network operator in accordance with the combined billing agreement.

12. The method of claim 1, further comprising transmitting the combined billing statement according to client contact information associated with the application or device.

13. The method of claim 1, further comprising referencing stored supplemental payment rules associated with the network operator in response to receiving the network report, or associated with the content provider in response to receiving the content report.

14. The method of claim 13, further comprising identifying an instant offer associated with charges for consumption of the network access resources or with charges for consumption of the media content, and transmitting the instant offer to the application or device in response to receiving the network report or the content report, and in response to identifying the instant offer.

15. The method of claim 14, further comprising facilitating provisioning of advertisement content, promotional content, marketing content or limited-use purchase agreement content to the application or device in conjunction with the instant offer.

16. The method of claim 14, further comprising determining whether the instant offer is accepted or rejected at the application or device, and determining compliance with terms of the instant offer in response to acceptance of the instant offer at the application or device.

17. The method of claim 16, further comprising modifying the compiled billing data in accordance with terms of the instant offer in response to the acceptance of the instant offer and in response to determining compliance with the terms of the instant offer.

18. The method of claim 16, further comprising issuing the separate billing statements or the combined billing statement unmodified in response to rejection of the instant offer or in response to determining non-compliance with the terms of the instant offer.

* * * * *